US007494387B2

(12) United States Patent
Ohshima et al.

(10) Patent No.: US 7,494,387 B2
(45) Date of Patent: Feb. 24, 2009

(54) ELECTRIC CONTACT AND SOCKET FOR ELECTRICAL PART

(75) Inventors: Hisao Ohshima, Saitama (JP); Leo Azumi, Saitama (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 11/854,177

(22) Filed: Sep. 12, 2007

(65) Prior Publication Data

US 2008/0064270 A1 Mar. 13, 2008

(30) Foreign Application Priority Data

Sep. 13, 2006 (JP) ..... 2006-247665

(51) Int. Cl.
*H01R 13/33* (2006.01)

(52) U.S. Cl. ..... 439/841

(58) Field of Classification Search ..... 439/841, 439/840, 827, 846, 824
See application file for complete search history.

(56) References Cited

U.S. PATENT DOCUMENTS 5,388,997 A * 2/1995 Grange et al. ..... 439/66
5,388,998 A * 2/1995 Grange et al. ..... 439/66
5,641,315 A * 6/1997 Swart et al. ..... 439/824
5,990,697 A * 11/1999 Kazama ..... 324/761
6,086,432 A * 7/2000 Frinker et al. ..... 439/841
6,471,554 B2 * 10/2002 Armistead et al. ..... 439/841
7,070,447 B1 * 7/2006 Montena ..... 439/578
7,110,827 B2 * 9/2006 Sage et al. ..... 607/116
7,316,593 B2 * 1/2008 Balsells ..... 439/827
2001/0039152 A1 * 11/2001 Armistead et al. ..... 439/841

FOREIGN PATENT DOCUMENTS

JP 3326095 7/2002

* cited by examiner

*Primary Examiner*—Jean F Duverne
(74) *Attorney, Agent, or Firm*—Staas & Halsey LLP

(57) ABSTRACT

An electric contact of a socket for an electrical part is disposed between a first electrical part and a second electrical part so as to electrically connect the first and second electrical parts, and includes: a first electrical part side contact member contacting the first electrical part; a second electrical part side contact member contacting the second electrical part, the coil spring including a first spring portion abutting against the first electrical part side contact member and a second spring portion abutting against the second electrical part side contact member. When the first electrical part contacts the first electrical part side contact member, an axis of the first spring portion inclines with respect to an axis of the second spring portion, and then, a portion of the first electrical part side contact member on a side contacting the first electrical part is transversely moved.

7 Claims, 14 Drawing Sheets

ELECTRIC CONTACT AND SOCKET FOR ELECTRICAL PART

BACKGROUND OF THE INVENTION

1. Field of the Invention

The present invention relates to an electric contact disposed between a first electrical part and a second electrical part for electrically connecting them, and also relates to a socket for an electrical part provided with such electric contact.

2. Related Art

A prior art provides a socket for an electrical part provided with an electric contact disposed between a first electrical part and a second electrical part so as to electrically connect them. For example, there has been provided a socket for an electrical part, which is provided with a socket body disposed on a printed circuit board and accommodated with an electrical part, in which the printed circuit board and the electrical parts are electrically connected through a plurality of electric contacts or contact pins disposed to the socket body. In a structure in which the electric contact has a terminal side contact member contacting a terminal of the electrical part and a substrate side contact member contacting the printed circuit board, a coil spring is disposed so as to form a close winging portion between the terminal side contact member and the substrate side contact member for shortening the electrical connection therebetween.

One example of the socket for an electrical part provided with such electrical contact having a coil spring is disclosed in Patent Publication 1 (Japanese Patent Publication No. 3326095). In this Patent Publication 1, there is shown "a socket for an electrical part including a contact provided with a terminal side contact member contacting a terminal of an electrical part, a substrate side contact member contacting a printed circuit board, and a coil spring urging the terminal side contact member and the substrate side contact member in a direction separated from each other, the coil spring being provided with a first spring portion abutting against the terminal side contact member, a second spring portion abutting against the substrate side contact member, and a close winding portion disposed between the first and second spring portions and wound up at the minimum pitch."

There is also disclosed in this Patent Publication 1 that "according to this structure, an electric signal is transmitted through the close winding portion, so that the electric signal may flow along an axial direction of the coil spring at the close winding portion, and accordingly, an increasing in inductance and resistance due to the flow of the high frequency electric signal in a coil-shape at a rough winding portion can be prevented from causing, thus achieving reduction of inductance and resistance".

However, in the invention disclosed in the Patent Publication 1, since the close winding portion is provided between the first and second spring portions, it is difficult to realize a structure in which an axis of the first spring portion inclines with respect to an axis of the second spring portion so that the terminal side contact member is inclined.

Therefore, in a case where the axis of the terminal of the electrical part is shifted from the axis of the terminal side contact member, the terminal side contact member does not follow the shifting of the terminal of the electrical part, which may result in fault in electric connection between the electrical part and the printed circuit board.

SUMMARY OF THE INVENTION

The present invention was therefore conceived in consideration of the prior art technologies mentioned above and an object thereof is to provide an electric contact of a socket for an electrical part in which an upper portion of the terminal side contact member moves following the shifting of the terminal of the electrical part, and the axis of the terminal and the axis of the terminal side contact member accord with each other so as to surely contact the terminal to the electrical part, and also provide a socket for an electrical part provided with such improved electric contact.

This and other objects can be achieved according to the present invention by providing, in one aspect, an electric contact disposed between a first electrical part and a second electrical part so as to electrically connect the first and second electrical parts, comprising:

a first electrical part side contact member contacting the first electrical part;

a second electrical part side contact member contacting the second electrical part, a coil spring urging the first electrical part side contact member and the second electrical part side contact member in a direction separating from each other, the coil spring including a first spring portion abutting against the first electrical part side contact member and a second spring portion abutting against the second electrical part side contact member, wherein when the first electrical part contacts the first electrical part side contact member, an axis of the first spring portion inclines with respect to an axis of the second spring portion, and then, a portion of the first electrical part side contact member on a side contacting the first electrical part is transversely moved.

According to this aspect, even if the position of the axis of the terminal of the first electrical part and the position of the axis of the terminal side contact member are shifted from each other, when the terminal of the first electrical part contacts the first electrical part side contact member, the axis of the first spring portion inclines with respect to the axis of the second spring portion, and the first electrical part side contact member abutting against the first spring portion inclines. Accordingly, the upper portion of the first electrical part side contact member follows the shifting of the terminal of the first electrical part, and the terminal and the electric contact can be surely contacted to each other in a manner such that the axis of the terminal of the first electrical part and the axis of the first electrical part side contact member accord with each other.

In a preferred embodiment of the above aspect, it may be desired that the first spring portion of the coil spring is a first close winding portion closely wound-up at a minimum pitch, the second spring portion is a normal winding portion including portion having a normal winding portion wound-up at a predetermined pitch, a rough winding portion is continuously formed between the first close winding portion and the normal winding portion so as to have a pitch larger than that of the first close winding portion and smaller than that of the normal winding portion, and when the first electrical part contacts the first electrical part side contact member, the rough winding portion is contracted so that a lower portion of the first close winding portion and an upper portion of the normal winding portion including portion are contacted to each other.

According to this embodiment, the pitch of the rough winding portion is smaller than that of the normal winding portion, so that after the rough winding portion is compressed so as to contact the first and second close winding portions to each other to provide a closely wound-up state, the normal winding portion can be compressed. Furthermore, by contacting the lower portion of the first close winding portion to the upper portion of the normal winding portion including portion, the electrical connection between the first and second electrical parts can be shortened (short-circuited), and the specific resistance of the electric contact can be reduced. In addition, since the first spring portion is the first close winding portion, it can be made difficult to entangle the first spring portion of one electric contact with the coil spring of another electric contact at the time of manufacturing a socket for an electrical part.

In another embodiment, it may be desired that an upper portion of the normal winding portion including portion is a second close winding portion continuously connected to an upper portion of the normal winding portion at a minimum pitch.

According to this embodiment, it can be made difficult to engage the inserting shank portion to be inserted into the coil spring of the second electrical part side contact member.

In a further embodiment, it may be desired that the first electrical part side contact member includes: a first electrical part side contact shank portion contacting the first electrical part; a first flanged portion provided for the lower portion of the first electrical part side contact shank portion so as to provide a wider diameter shape; and an inserting projection formed from the lower portion of the first flanged portion so as to project downward and to be inserted into the first spring portion from an upper side thereof, the second electrical part side contact member includes: a second electrical part side contact shank portion contacting the second electrical part; a second flanged portion provided for the upper portion of the second electrical part side contact shank portion so as to provide a wider diameter shape; and an inserting shank portion formed from the upper portion of the second flanged portion so as to project upward and to be inserted into the second spring portion from a lower side thereof, and the rough winding portion is disposed between the inserting projection and the inserting shank portion.

According to this embodiment, since the rough winding portion is formed between the first electrical part side contact member and the second electrical part side contact member, the electrical connection between the first and second electrical parts can be shortened at a portion at which the first and second electrical part side contact members are not contacted. In addition, the rough winding portion is contracted while inclining, so that the axis of the first spring portion can be easily inclined with respect to the axis of the second spring portion.

It may be further desired that the inserting projection has a height smaller than a length of the first close winding portion.

According to this feature, the fear of engaging the inserting projection with the inner side of the second spring portion can be prevented, and the terminal side contact member can be easily and smoothly inclined in the transverse direction.

It may be further desired that a lower portion of the normal winding portion including portion constitutes a third close winding portion continuously connected to the lower portion of the normal winding portion at a minimum pitch, and a lower end of the third close winding portion abuts against the second flanged portion of the second electrical part side contact member.

According to this structure, since the lower portion of the second spring portion constitutes the third closely wound portion, the second spring portion of one electric contact becomes less entangled with the coil spring of another electric contact at the time of manufacturing the socket for an electrical part.

It may be further desired that the first spring portion is a small pitch winding portion and the second spring portion is a large pitch winding portion including portion having a pitch larger than that of the first spring portion, and when the first electrical part contacts the first electrical part side contact member, the small pitch winding portion is compressed into a closely wound-up state having a minimum pitch.

According to this embodiment, during the process in which the gap between the turns of the vertically adjacent spring portions of the small pitch winding portion is transferred from the opened state to the closely wound-up state, either one of the first electrical part side contact member or the second electrical part side contact member is moved or inclined in the transverse direction, and if the axes of the first and second electrical part side contact members are shifted from each other, the coil spring can follow such shifting.

According to another aspect of the present invention, there is also provided an electric contact disposed between a first electrical part and a second electrical part so as to electrically connect the first and second electrical parts, comprising:

a first electrical part side contact member contacting the first electrical part; and a coil spring contacting the second electrical part so as to urge the second electrical part to separate the first electrical part side contact member and the second electrical part from each other, the coil spring having a large pitch winding portion abutting against the first electrical part side contact member and a small pitch winding portion being continuous to the large pitch winding portion and having a pitch smaller than that of the large pitch winding portion, wherein when the first electrical part contacts the first electrical part side contact member, the small pitch winding portion is compressed to a closely wound-up state at a minimum pitch, and an axis of the small pitch winding portion inclines with respect to an axis of the large pitch winding portion, so that a portion of the first electrical part side contact member on a side contacting the first electrical part is transversely moved.

According to this aspect, during the process in which the gap between the turns of the vertically adjacent spring portions of the small pitch winding portion is transferred from the opened state to the closely wound state, even if the first electrical part side contact member is moved or inclined in the transverse direction, and the axis of the first and electrical part side contact members is moved or inclined, the coil spring can follow such shifting as a whole.

Furthermore, in a further aspect of the present invention, there is provided a socket for an electrical part including a socket body and an electric contact disposed between a first electrical part and a second electrical part so as to electrically connect the first and second electrical parts, the electric contact including: a first electrical part side contact member contacting the first electrical part; a second electrical part side contact member contacting the second electrical part, the coil spring including a first spring portion abutting against the first electrical part side contact member and a second spring portion abutting against the second electrical part side contact member, wherein when the first electrical part contacts the first electrical part side contact member, an axis of the first spring portion inclines with respect to an axis of the second spring portion, and then, a portion of the first electrical part side contact member on a side contacting the first electrical part is transversely moved, and wherein the first electrical part is an IC package, the second electrical part is a printed circuit board, the first electrical part side contact member is a terminal side contact member contacting a terminal of the IC package, and the second electrical part side contact member is a substrate side contact member contacting the printed circuit board.

In this socket for an electrical part, it may be desired that the socket body in which the IC package is accommodated has a plate through which the terminal side contact member is inserted, the plate is provided with a small diameter through hole through which the terminal side contact shank portion is inserted and a large diameter through hole through which the first flanged portion is inserted, a first gap having a predetermined size is formed between the small diameter through hole and the terminal side contact shank portion, a second gap having a predetermined size is formed between the large diameter through hole and the first flanged portion, and the terminal side contact member is tilted between the small diameter through hole and the large diameter through hole.

According to the above structures, there can be provided a socket for an electrical part including the electric contacts each having the improved structures or characters mentioned above.

The nature and further characteristic features of the present invention will be made clearer from the following descriptions made with reference to the accompanying drawings.

BRIEF DESCRIPTION OF THE DRAWINGS

In the accompanying drawings:

FIG. 4A is a front view of the terminal side contact member, FIG. 4B is a front view of the substrate side contact member, FIG. 4C is a perspective view viewing a contact recess of the terminal side contact member from an obliquely upper direction, FIG. 4D is a front view, partially broken away, in an enlarged scale, of the contact recess of FIG. 4C and FIG. 4E is a plan view of the contact recess;

FIG. 5A is a sectional view showing a state in which the printed circuit board and the IC package are not disposed, and FIG. 5B is a sectional view showing a state in which the IC socket is disposed on the printed circuit board;

FIG. 7A is a sectional view showing a state in which the printed circuit board and the IC package are not disposed, and FIG. 7B is a sectional view showing a state in which the IC socket is disposed on the printed circuit board;

FIG. 8A is a sectional view of the present invention showing a state in which the printed circuit board and the IC package are disposed, and a small pitch winding portion has an upper side portion and a lower side portion which are aligned on different axes respectively, and FIG. 8B is a sectional view of the comparative example showing a state in which a small pitch winding portion has an upper side portion and a lower side portion which are both aligned on a same axis;

FIG. 11A is a front view of a coil spring and FIG. 11B is a sectional view showing a state in which a socket body is not disposed on the printed circuit board and the IC package is also not disposed on the socket body;

FIG. 12A is a sectional view showing a state in which the socket body is disposed on the printed circuit board and FIG. 12B is a sectional view showing a state in which the IC package is disposed on the socket body, and the terminal side contact member is lowered;

DESCRIPTION OF THE PREFERRED EMBODIMENT

Hereunder, preferred embodiments of the present invention will be described with reference to the accompanying drawings. It is first to be noted that terms "upper", "lower", "right", "left" and the like terms are used herein with reference to the accompanying drawings or in an actually installed state of the electric contact and so on.

First Embodiment

FIG. 1 to FIG. 4 represent a first embodiment of the present invention.

Figure 1:
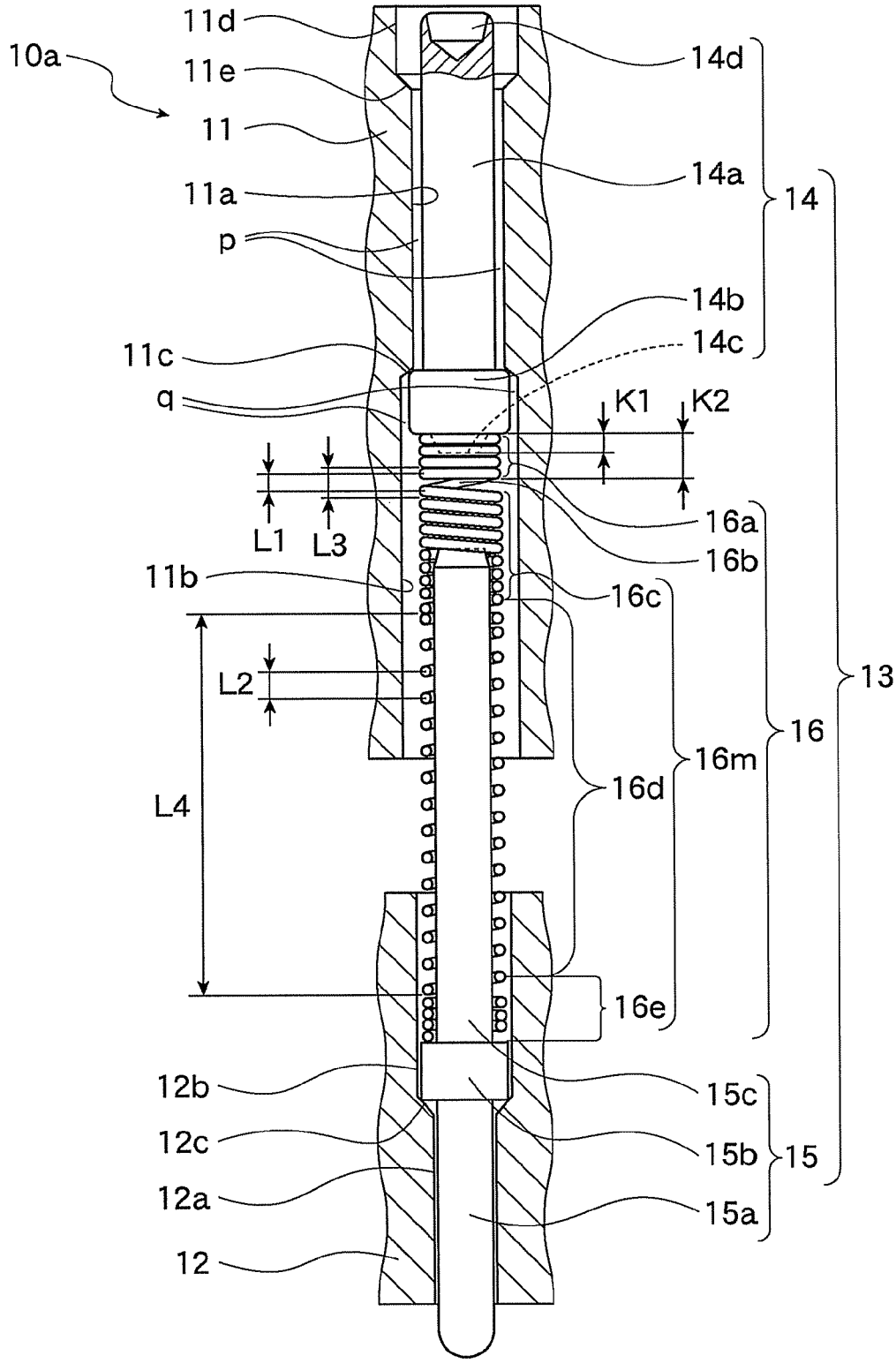
FIG. 1 is a sectional view showing a portion of an IC socket according to a first embodiment of the present invention.

First, with reference to FIG. 1, a structure of the first embodiment will be briefly described.

A socket body 10*a* of an IC socket as "socket for an electrical part" is provided with an upper plate 11 and a lower plate 12, both having a plate-shape. The socket body 10*a* is disposed on a printed circuit board 2 (shown in FIG. 2) and is accommodated with an IC package 1 (shown in FIG. 3) as "first electrical part". In addition, a plurality of electric contacts 13 (or contact pins) are disposed to the socket body 10*a*, and the IC package 1 as first electrical part and the printed circuit board 2 as "second electrical part" are electrically connected through the electric contacts 13. Further, in FIG. 1, although only a single electric contact 13 is shown, in actual arrangement, a plurality of electric contacts 13 are arranged to the socket body 10*a*.

Figure 3:
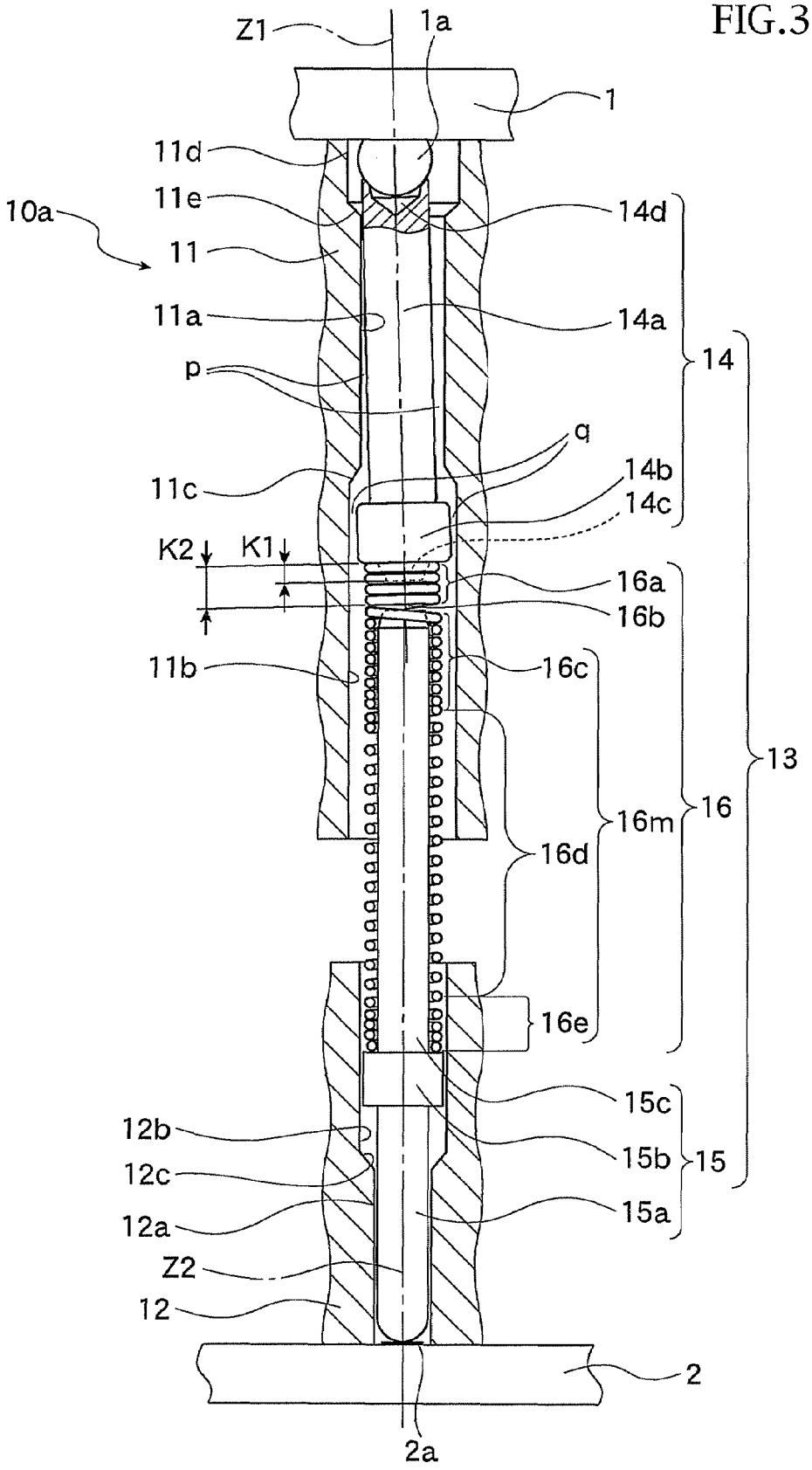
FIG. 3 is also a sectional view of the portion shown in FIG. 1 in which an IC package is accommodated in the IC socket after the IC socket has been mounted to the printed circuit board.

The electric contact 13 is provided with, as shown in FIG. 3, a terminal side contact potion 14 as "first electrical part side contact member" formed with a contact recess 14*d* into which a solder ball 1*a* of the IC package 1 is inserted in a contacting manner, a substrate side contact member 15 as "second electrical part side contact member" contacting the printed circuit board 2, and a coil spring 16 urging the terminal side contact member 14 and the substrate side contact member 15 in a direction separating from each other. The contact recess 14*d* is provided with, as shown in FIGS. 4C to 4E, a large circular recessed portion 14*d*-1 and a small circular recessed portion 14*d*-2, into which the solder ball 1*a* (shown in FIG. 3) as "terminal" of the IC package 1 is inserted.

Figure 4A:
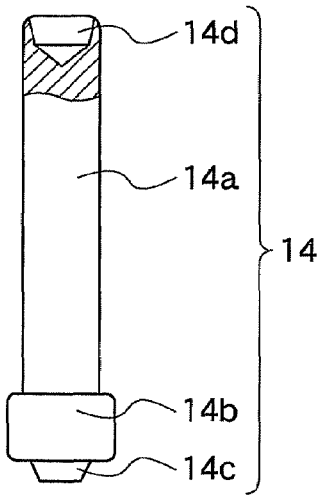
FIGS. 4A, 4B, 4C, 4D, 4E show a terminal side contact member and a substrate side contact member according to the first embodiment.
Figure 4C:
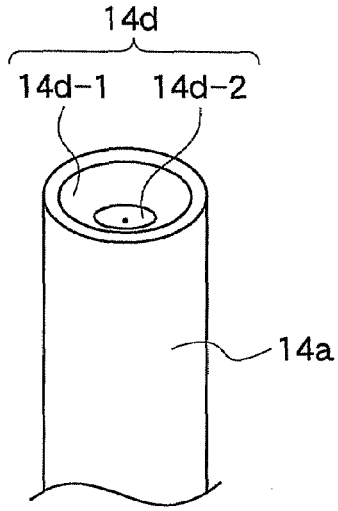

The terminal side contact member 14 is provided with, as shown in FIG. 4A, a terminal side contact shank portion 14*a* contacting the solder ball 1*a* as shown in FIG. 3, a first flanged portion 14*b* having a wide diameter and formed to a lower side of the terminal side contact shank portion 14*a*, and an inserting projection 14*c* which is formed so as to project downward from the first flanged portion 14*b* into the coil spring 16 from the upper side thereof. Further, as shown in FIG. 1, the inserting projection 14*c* has a height K1 (longitudinal length) is set to be smaller than a length K2 of a first close winding portion 16*a* of the coil spring 16 as mentioned hereinlater.

Figure 4B:
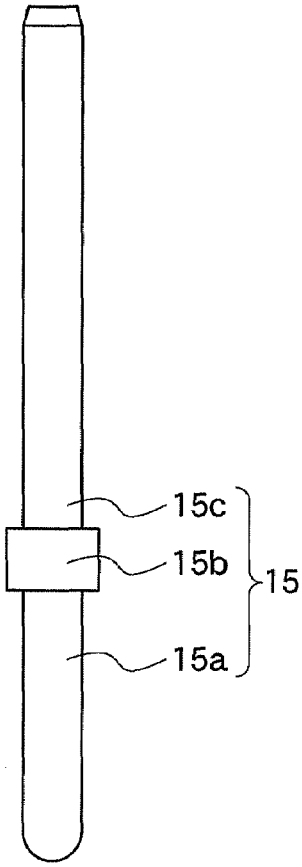
Figure 4D:
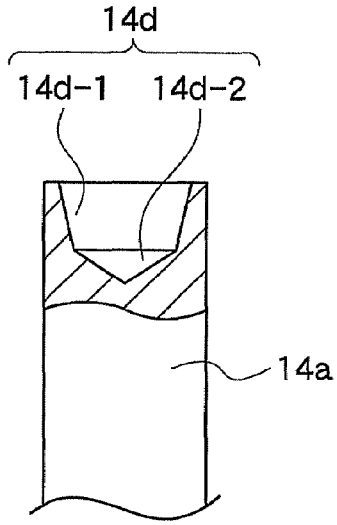
Figure 4E:
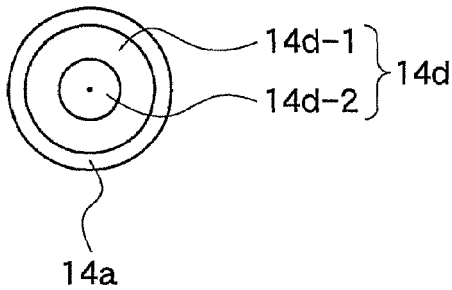

The substrate side contact member 15 is provided with, as shown in FIG. 4B, a terminal side contact shank portion 15*a* contacting an electrode 2*a* (see FIG. 2) of the printed circuit board 2, a second flanged portion 15*b* having a wide diameter and disposed above the substrate side contact shank portion 15*a*, and an inserting shank portion 15*c* which projects upward from the upper portion of the second flanged portion 15*b* so as to be inserted into the coil spring 16 from the lower side thereof.

Figure 2:
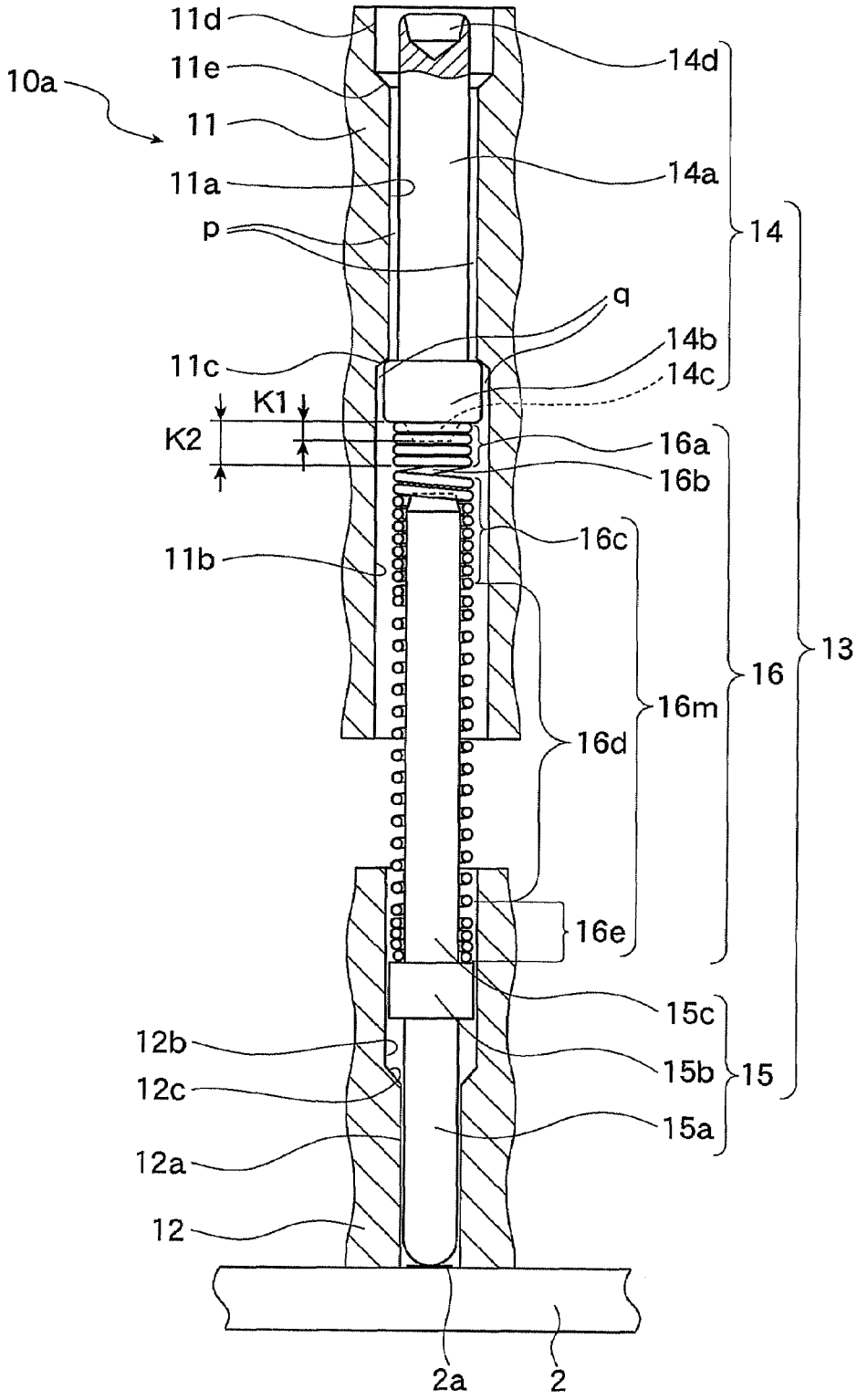
FIG. 2 is a sectional view of the portion shown in FIG. 1 in which the IC socket is mounted to a printed circuit board.

The coil spring 16 is provided with, as shown in FIGS. 1 to 3, from the upper side, a first close winding portion 16*a* as "first spring portion", a rough winding portion 16*b*, and a remaining normal winding portion including portion 16*m* as "second spring portion". This normal winding portion including portion 16*m* includes a second close winding portion 16*c*, a normal winding portion 16*d* and a third close winding portion 16*e* in this order from the upper side.

The first close winding portion 16*a* is a portion closely wound up at minimum pitch, and the length K2 of this first close winding portion 16*a* is longer than the height K1 of the insertion projection 14*c*. The upper portion of the first close winding portion 16*a* abuts against the first flanged portion 14*b* of the terminal side contact member 14.

The normal winding portion including portion 16*m* includes the normal winding portion 16*d* having a pitch L2 larger than a pitch L1 of the rough winding portion 16*b*. The second close winding portion 16*c* is formed to be continuous to the upper portion of the normal winding portion 16*d*, and the third close winding portion 16*e* is formed to be continuous to the lower portion of the normal winding portion 16*d*.

The second close winding portion 16*c* is composed of a portion closely wound up at the minimum pitch, and is contacted, at its lower portion, continuously to the upper portion of the normal winding portion 16*d*.

The third close winding portion 16*e* is composed of a portion closely wound up at the minimum pitch, and is contacted, at its upper portion, continuously to the lower portion of the normal winding portion 16*d* so that the lower portion of the third close winding portion 16*e* abuts against the second flanged portion 15*b* of the substrate side contact member 15.

Furthermore, the rough winding portion 16*b* is disposed between the first close winding portion 16*a* and the second close winding portion 16*c* at a pitch larger than that of the first close winding portion 16*a* and smaller than that of the normal winding portion 16*d*. The rough winding portion 16*b* is positioned between the spring inserting projection 14*c* of the terminal side contact member 14 and the inserting shank portion 15*c* of the substrate side contact member 15.

As shown in FIG. 1, the pitch L1 of the rough winding portion 16*b* is smaller than the pitch L2 of the normal winding portion 16*d*, and the length L3 of the rough winding portion 16*b* is shorter than the length L4 of the normal winding portion 16*d*. That is, the electric contact 13 is accommodated in the plates 11 and 12, but in the state in which the electric contact 13 does not contact the printed circuit board 2 and the IC package 1, as shown in FIG. 1, the pitch L1 of the rough winding portion 16*b* and the pitch L2 of the normal winding portion 16*d* have a relationship of L1<L2.

Accordingly, in the coil spring 16, in the process that the solder ball 1*a* of the IC package 1 is accommodated in the contact recess 14*d* of the terminal side contact member 14, when a load is applied from the upper side of the first close winding portion 16*a*, the rough winding portion 16*b* is first compressed, then, the normal winding portion 16*d*, the lower portion of the first close winding portion 16*a* and the upper portion of the second close winding portion 16*c* are contacted to each other, and thereafter, the normal winding portion 16*d* is contracted.

Further, the length L4 of the normal winding portion 16*d* is longer than the length L3 of the rough winding portion 16*b*. Therefore, even after the contact of the lower portion of the first close winding portion 16*a* to the upper portion of the second close winding portion 16*c*, the normal winding portion 16*d* can be sufficiently contracted to thereby achieve the elastic performance.

When the solder ball 1*a* of the IC package 1 is accommodated in the contact recess 14*d*, as shown in FIG. 3, the rough winding portion 16*b* is contracted, and the axis Z1 of the first close winding portion 16*a* as the "first spring portion" is inclined with respect to the axis Z2 of the normal winding portion including portion 16*m* as the "second spring portion", and the terminal side contact member 14 is then inclined, thereby the contact recess 14*d* of the terminal side contact member 14 being movable in the transverse direction.

The socket body 10*a* in which the IC package 1 is accommodated is provided with the upper plate 11 and the lower plate 12 as mentioned hereinbefore. The upper plate 11 is provided, as shown in FIGS. 1 to 3, with a through hole 11*a* having a small diameter through which the terminal side contact shank portion 14*a* is inserted, a though hole 11*b* having a large diameter through which the first flanged portion 14*b* is inserted, and a tapered portion 11*c* between these small and large diameter through holes 11*a* and 11*b*, thus the terminal side contact member 14 being inserted therethrough.

On the other hand, the lower plate 12 is provided, as shown in FIGS. 1 to 3, with a through hole 12*a* having a small diameter through which the substrate side contact shank portion 15*a* is inserted, a though hole 12*b* having a large diameter through which the second flanged portion 15*b* is inserted, and a tapered portion 12*c* between these small and large diameter through holes 12*a* and 12*b*, thus the substrate side contact member 15 being inserted therethrough.

In addition to these arrangements, a terminal accommodation hole 11*d* is formed on the upper surface side of the upper plate 11 above the small diameter through hole 11*a*, and a tapered portion 11*e* is formed between this terminal accommodation hole 11*d* and the small diameter through hole 11*a*.

A first gap "p" having a predetermined size is formed between the small diameter through hole 11*a* and the terminal side shank portion 14*a*, and a second gap "q" having a predetermined size is formed between the large diameter through hole 11*b* and the first flanged portion 14*b*. By the formation of these gaps "p" and "q", the terminal side contact member 14 is tilted in the small diameter through hole 11*a*, the large diameter through hole 11*b*, the terminal accommodation hole 11*d* and the tapered portion 11*e*.

Hereunder, the operation of the electric contact 13 according to this first embodiment of the present invention will be described.

First, the electric contact 13 has an expanded state by the urging force of the coil spring 16, as shown in FIG. 1, and especially, the rough winding portion 16*b* and the normal winding portion 16*d* are in the expanded state. At this time, the first flanged portion 14*b* of the terminal side contact member 14 is engaged with the tapered portion 11*c* formed between the small and large diameter though holes 11*a* and 11*b* to thereby block the invasion of the first flanged portion 14*b* into the small diameter through hole 11*a*, and on the other hand, the second flanged portion 15*b* of the substrate side contact member 15 is engaged with the tapered portion 12*c* formed between the small and large diameter through holes 12*a* and 12*b* to thereby block the invasion of the second flanged portion 15*b* into the small diameter through hole 12*a*.

Next, with reference to FIG. 2, the socket body 10*a* of the IC socket is mounted on the printed circuit board 2. Then, the substrate side contact shank portion 15*a* is pressed by the printed circuit board 2, and the coil spring 16 is contracted by the upward movement of the second flanged portion 15*b*.

Under the state, as shown in FIG. 3, when the IC package 1 is mounted on the upper plate 11 of the socket body 10*a* in a manner such that the axis of the solder ball 1*a* and the axis of the electric contact 13 are offset, the terminal side contact member 14 is inclined, and during the terminal side contact shank portion 14*a* is being pressed by the solder ball 1*a* and lowered, the rough winding portion 16*b* is contracted and the first close winding portion 16*a* is lowered so that the axis Z1 of the first close winding portion 16*a* is inclined with respect to the axis Z2 of the second close winding portion 16*c*. Then, upon the contact of the lower portion of the first close winding portion 16*a* to the upper portion of the second close winding portion 16*c*, the electrical contact between the IC package 1 and the printed circuit board 2 is shortened.

After the rough winding portion 16*b* is contracted in a close contact winding state, the normal winding portion 16*b* is then contracted.

According to the IC socket of the characters mentioned above, the electric contact 13 includes: the terminal side contact member 14 having the end portion formed with the contact recess 14*d* in which the solder ball 1*a* of the IC package 1 is inserted; the substrate side contact member 15 contacting the printed circuit board 2; and the coil spring 16 urging the terminal side contact member 14 and the substrate side contact member 15 in the direction separating from each other.

The coil spring 16 includes the first close winding portion 16*a* as "first spring portion" contacting the terminal side contact member 14, the normal winding portion including portion 16*m* as "second spring portion" contacting the substrate side contact member, and the rough winding portion 16*b* formed between the first close winding portion 16*a* and the second close winding portion 16*c* and having the pitch larger than that of the first close winding portion 16*a* and smaller than that of the normal winding portion 16*d*.

When the solder ball 1*a* of the IC package 1 is accommodated in the contact recess 14*d*, the rough winding portion 16*b* is contracted, and the axis Z1 of the first close winding portion 16*a* is inclined with respect to the axis Z2 of the normal winding portion including portion 16*m*, thereby inclining the terminal side contact member 14 and freely moving transversely the contact recess 14*d* of the terminal side contact member 14.

Accordingly, even if the position of the axis of the solder ball 1*a* of the IC package is shifted from the position of the axis of the terminal side contact member 14, when the solder ball 1*a* of the IC package 1 is accommodated in the contact recess 14*d* of the terminal side contact member 14, the rough winding portion 16*b* is compressed and the axis of the first close winding portion 16*a* as "first spring portion" is inclined with respect to the axis of the normal winding portion including portion 16*m* as "second spring portion", and in addition, the terminal side contact member abutting against the first close winding portion 16*a* is inclined. Accordingly, the upper portion of the terminal side contact member 14 moves, following the shifting of the solder ball 1*a* of the IC package 1, and the solder ball 1*a* and the electric contact 13 can be surely contacted in the manner such that the axis of the solder ball 1*a* and the axis of the terminal side contact member 14 are aligned with each other.

In addition, the pitch of the rough winding portion 16*b* is smaller than the pitch of the normal winding portion 16*d*, so that after the rough winding portion 16*b* is compressed and the first and second close winding portions 16*a* and 16*c* are contacted in a close winding state, the normal winding portion 16*d* is then compressed and contracted.

Furthermore, the first close winding portion 16*a* is closely wound-up at the minimum pitch, the normal winding portion 16*d* is formed at a predetermined pitch, and the rough winding portion 16*b* is formed between the first close winding portion 16*a* and the normal winding portion including portion 16*m* at a pitch larger than that of the first close winding portion 16*a* and smaller than that of the normal winding portion 16*d*. In the state in which the solder ball 1*a* of the IC package 1 has been completely accommodated in the contact recess 14*d*, the rough winding portion 16*b* is contracted so that the lower portion of the first close winding portion 16*a* contacts the upper portion of the second close winding portion 16*c*. For this reason, by contacting the lower portion of the first close winding portion 16*a* to the upper portion of the second close winding portion 16*c*, the electrical connection between the IC package 1 and the printed circuit board 2 can be shortened. Therefore, the specific resistance of the electric contact 13 is reduced. Further, the formation of the first close winding portion 16*a* may make it difficult to entangle the first close winding portion 16*a* of one electric contact with the coil spring 16 of another electric contact 13 at the time of manufacturing the IC socket.

Furthermore, the terminal side contact member 14 is provided with the terminal side contact shank portion 14*a* contacting the solder ball 1*a*, the first flanged portion 14*b* having a wide diameter and formed to the lower side of the terminal side contact shank portion 14*a*, and the inserting projection 14*c* which is formed so as to project downward from the lower portion of the first flanged portion 14*b* into the first close winding portion 16*a* from the upper side thereof.

Further, the substrate side contact member 15 is provided with the substrate side contact shank portion 15*a* contacting the printed circuit board 2, the second flanged portion 15*b* having a wide diameter and disposed above the substrate side contact shank portion 15*a*, and the inserting shank portion 15*c* which projects upward from the upper portion of the second flanged portion 15*b* so as to be inserted into the coil spring 16 from the lower side of the normal winding portion including portion 16*m*.

Accordingly, the rough winding portion 16*b* is arranged between the terminal side contact member 14 and the substrate side contact member 15, so that the electrical connection between the IC package 1 and the printed circuit board 2 is shortened at a portion at which the terminal side contact member 14 and the substrate side contact member 15 are not contacted to each other. Moreover, since the rough winding portion 16*b* is arranged between the terminal side contact member 14 and the substrate side contact member 15, the axis of the first close winding portion 16*a* is easily inclined with respect to the axis of the normal winding portion including portion 16*m* by the contraction of the rough winding portion 16*b* while being inclined.

Still furthermore, the height K1 of the inserting projection 14*c* is smaller than the length K2 of the first close winging portion 16*a*. In the case where the height K1 of the inserting projection 14*c* is larger than the length K2 of the first close winding portion 16*a*, there is a fear of engaging the inserting projection 14*c* with the inside portion of the normal winding portion including portion 16*m*. However, according to this embodiment, such engaging can be obviated, and the terminal side contact member 14 can be easily and smoothly inclined transversely.

Still furthermore, the upper portion of the normal winding portion including portion 16*m* is connected to the upper portion of the normal winding portion 16*d* so as to form the second close winding portion 16*c* at the minimum pitch, and accordingly, the inserting projection 15*c* of the substrate side contact member 15 is hard to be engaged with the upper portion of the normal winding portion including portion 16*m*.

Still furthermore, the lower portion of the normal winding portion including portion 16*m* constitutes the third close winding portion 16*e*, the upper portion of the third close winding portion 16*e* is continued to the lower portion of the normal winding portion 16*d*, and the lower end portion of the third close winding portion 16*e* abuts against the second flanged portion 15*b* of the substrate side contact member 15. Accordingly, the lower portion of the normal winding portion including portion 16*m* constitutes the third close winding portion 16*e*, which makes it difficult to entangle the normal winding portion including portion 16*m* of one electric contact 13 with the coil spring 16 of another electric contact 13 at the time of manufacturing the socket of the electrical part.

Still furthermore, the socket body 10*a* is provided with the upper plate 11, which is provided with the through hole 11*a* having a small diameter through which the terminal side contact shank portion 14*a* is inserted, and the though hole 11*b* having a large diameter through which the first flanged portion 14*b* is inserted. The first gap "p" having a predetermined size is formed between the small diameter through hole 11*a* and the terminal side shank portion 14*a*, and the second gap "q" having a predetermined size is formed between the large diameter through hole 11*b* and the first flanged portion 14*b*. By the formation of these gaps "p" and "q", the terminal side contact member 14 is tilted in the small diameter through hole 11*a* and the large diameter through hole 11*b*. Accordingly, by the formation of these gaps "p" and "q", the terminal side contact member 14 is easily tilted.

Further, according to the described embodiment of the present invention, although the rough winding portion 16*b* is composed of one turn of the winding, the present invention is not limited to such embodiment. That is, the rough winding portion 16*b* may be composed of a plurality turns of the windings as far as the pitch L1 of the rough winding portion 16*b* is smaller than the pitch L2 of the normal winding portion 16*d*.

Furthermore, according to this first embodiment, in the normal winding portion including portion 16*m*, the second close winding portion 16*c* is continuously connected to the upper portion of the normal winding portion 16*d*, and the third close winding portion 16*e* is continuously connected to the lower portion of the normal winding portion 16*d*, but the present invention is not limited to this embodiment. That is, as far as the first close winding portion 16*a*, the rough winding portion 16*b*, and the normal winding portion 16*d* are provided, and the axis of the first close winding portion 16*a* can be inclined with respect to the axis of the normal winding portion including portion 16*m*, the second close winding portion 16*c* or the third close winding portion 16*e* may be substituted with the normal winding portion 16*d*. That is, the normal winding portion including portion 16*m* may be entirely formed as the normal winding portion 16*d*.

Second Embodiment

The second embodiment of the present invention will be described hereunder with reference to FIGS. 5 to 10B.

In this second embodiment, same reference numerals are added to portions or elements corresponding to those in the first embodiment, and detailed explanation thereof is omitted herein.

This second embodiment differs from the first embodiment in the point that a coil spring 26 is used in place of the coil spring 16 in the first embodiment.

In this second embodiment, as shown in FIGS. 5 to 8B, a socket body 20*a* of an IC socket as "socket for an electrical part" is provided with a vertically movable mount plate 21, as a "plate member", on which an IC package 1 (FIG. 6) is mounted, an upper plate 22 and a lower plate 23.

Figure 5A:
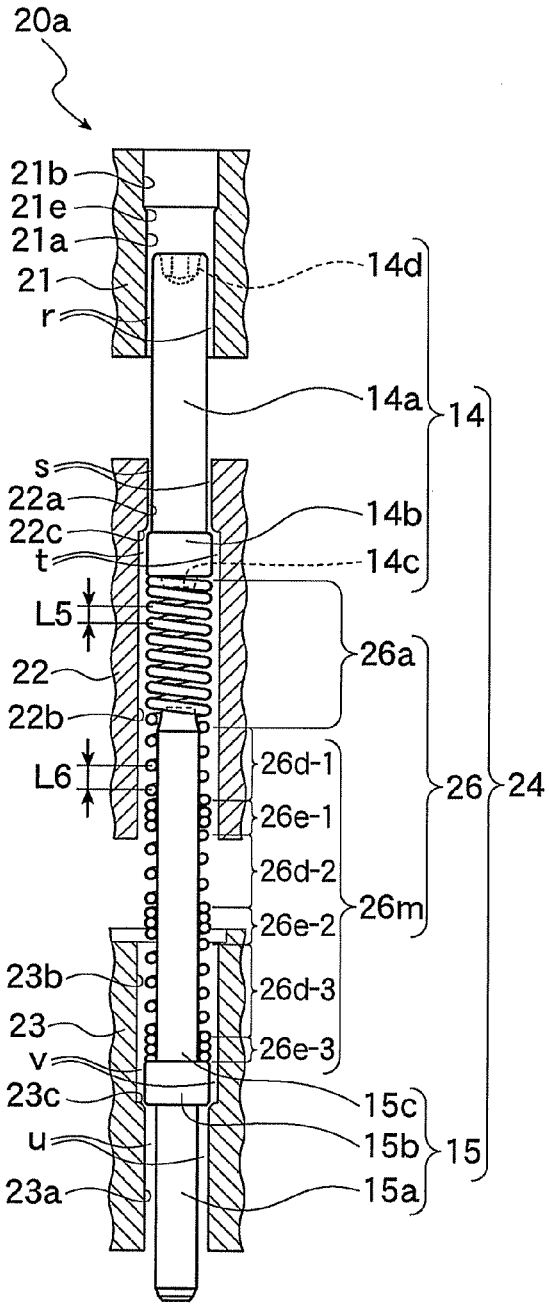
FIGS. 5A, 5B represent a second embodiment of an IC socket according to the present invention, which shows a case that an axis of the terminal side contact member and an axis of the substrate side contact member are not shifted from each other.
Figure 5B:
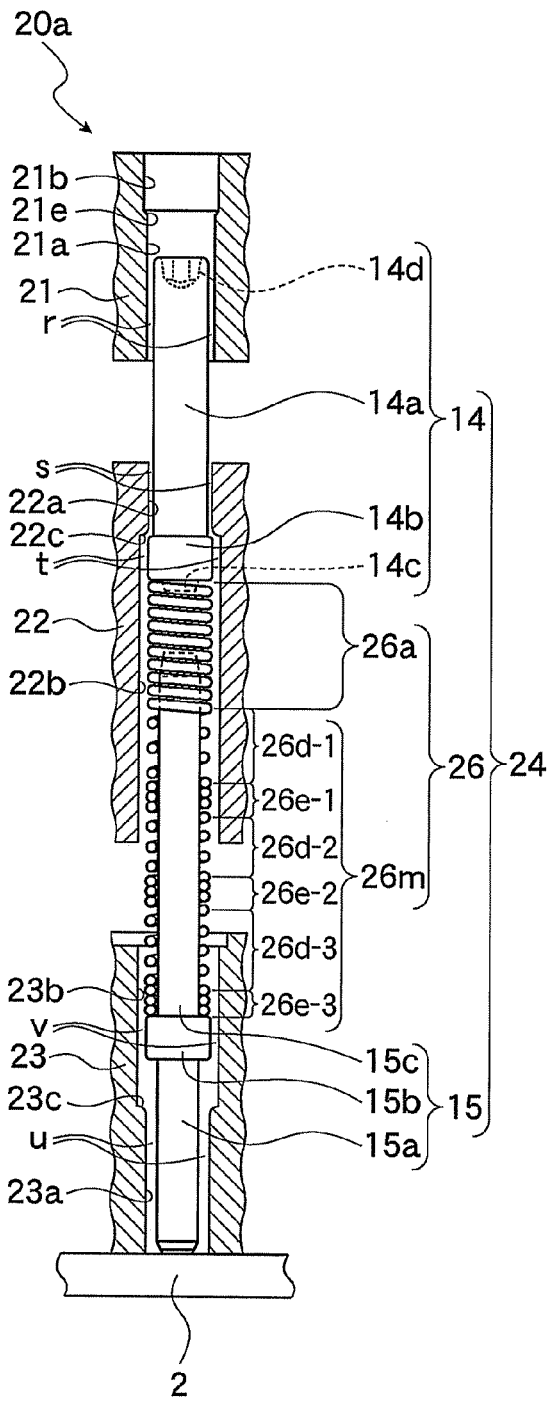
Figure 6:
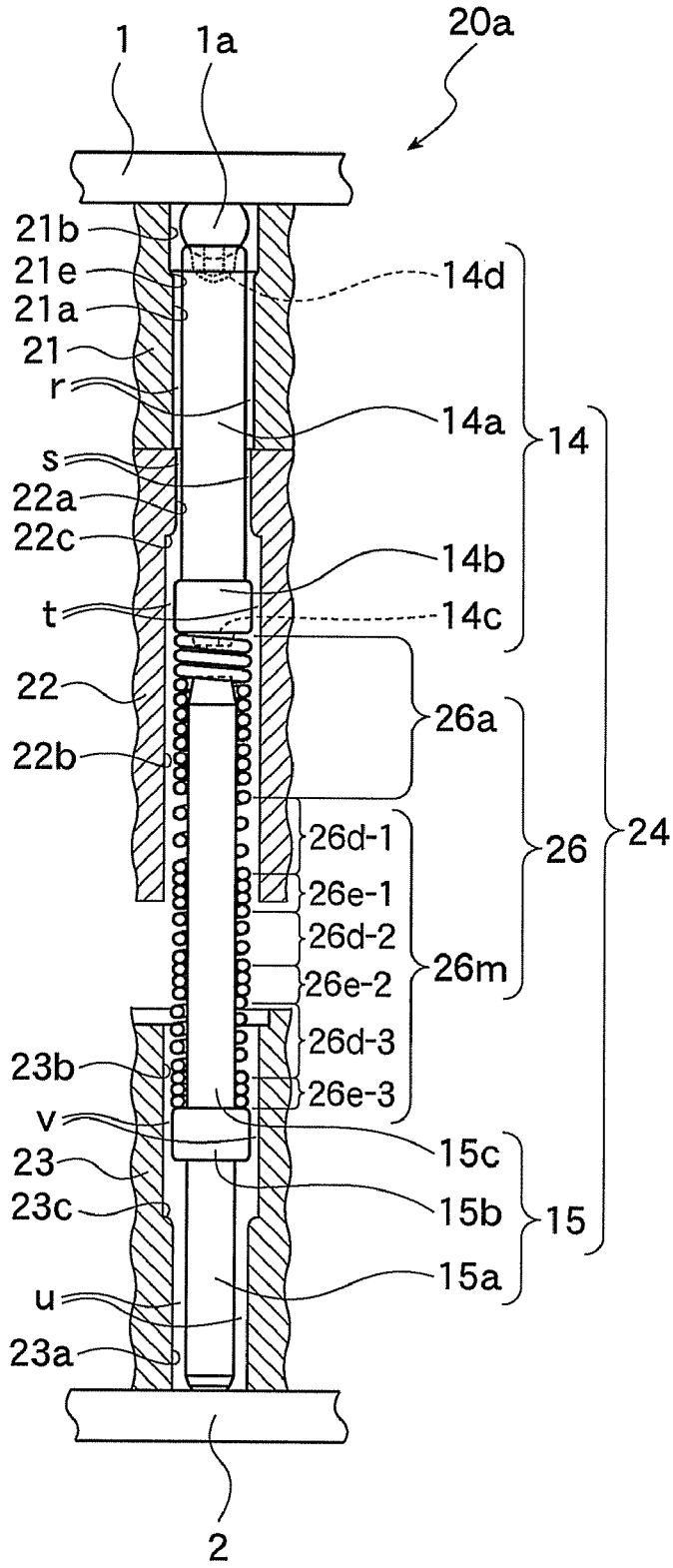
FIG. 6 is a sectional view of the IC socket according to the second embodiment in which the axis of the terminal side contact member and the axis of the substrate side contact member are not shifted from each other and, in this state, the printed circuit board and the IC package are disposed.
Figure 7A:
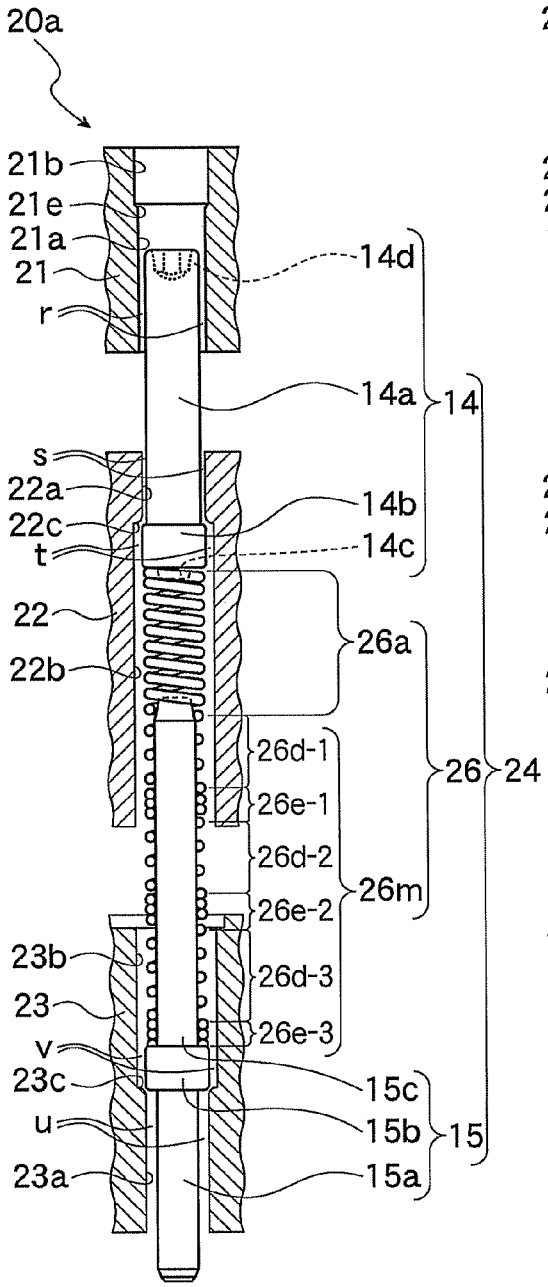
FIGS. 7A, 7B show a state in which the axis of the terminal side contact member and the axis of the substrate side contact member are shifted from each other in the IC socket of this second embodiment.
Figure 7B:
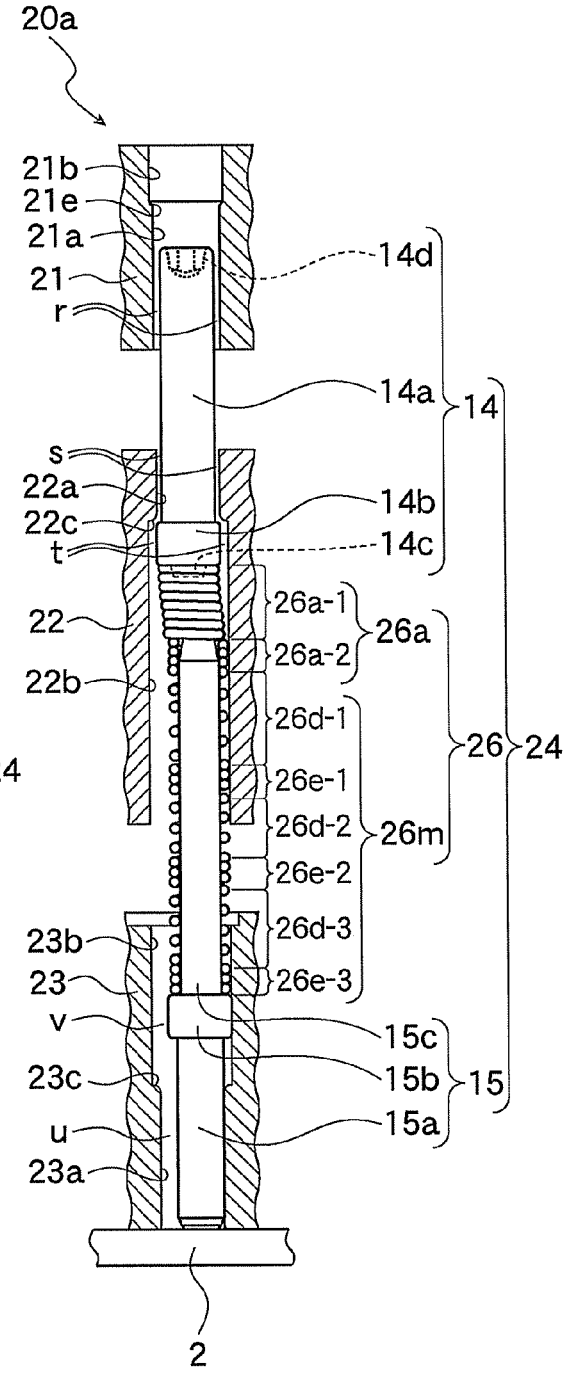
Figure 8A:
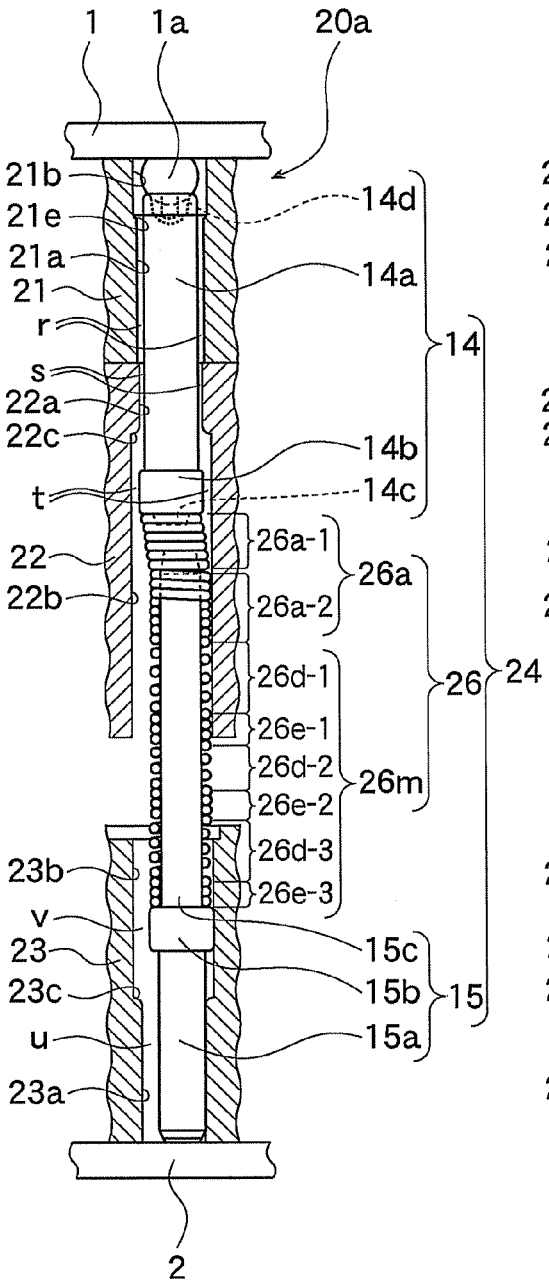
FIGS. 8A and 8B show a state in which the axis of the terminal side contact member and the axis of the substrate side contact member are shifted from each other in the IC socket.

The socket body 20*a* is disposed on a printed circuit board 2 (FIG. 5B, 6, 7B, or 8A), and is accommodated with the IC package 1 (FIG. 6 or 8A). A plurality of electric contacts 24 are arranged to the socket body 20*a*, through which the printed circuit board 2 as "second electrical part" and the IC package 1 as "first electrical part" are electrically connected. Further, in FIGS. 5A to 8B, although only single electric contact 24 is described, in actual, a plurality of electric contacts 24 are disposed to the socket body 20*a*.

The electric contact 24 is provided with a terminal side contact member 14, a substrate side contact member 15 and a coil spring 26. The coil spring 26 is composed of a small pitch winding portion 26*a* as "first spring portion" and a large pitch winding portion including portion 26*m* as "second spring portion" continuously connected to the lower portion of the small pitch winding portion 16*a*. The large pitch winding portion including portion 26*m* includes large pitch winding portions 26*d*-1 to 26*d*-3.

The small pitch winding portion 26*a* has a small pitch. The inserting portion 14*c* of the terminal side contact member 14 is inserted into an upper portion of the small pitch winding portion 26*a*, and the upper portion thereof abuts, in the inserted state, against the lower end of the first flanged portion

14*b*. However, the small pitch winding portion 26*a* is not a minimum pitch portion. There is a certain clearance between adjacent turns of winding.

On the other hand, in the large pitch winding portion including portion 26*m*, the large pitch winding portions 26*d*-1 to 26*d*-3 are formed so as to provide a pitch larger than that of the small pitch winding portion 26*a*. The inserting shank portion 15*c* of the substrate side contact member 15 is inserted into the lower portion of the large pitch winding portion including portion 26*m*, and this lower portion thereof abuts against the upper end of the second flanged portion 15*b*.

Furthermore, the large pitch winding portion including portion 26*m* includes, as shown in FIGS. 5A to 8B, the large pitch winding portion 26*d*-1, the close winding portion 26*e*-1, the large pitch winding portion 26*d*-2, the close winding portion 26*e*-2, the large pitch winding portion 26*d*-3, and the close winding portion 26*e*-3, continuously in this order from the small pitch winding portion 26*a* side. The close winding portions 26*e*-1 to 26*e*-3 are formed so as to prevent the coil spring from entangling with other coil springs.

As shown in FIG. 5A, in the state in which the electric contact 24 does not contact the IC package 1 or printed circuit board 2, the pitch L5 of the small pitch winding portion 26*a* is smaller than the pitch L6 of the large pitch winding portions 26*d*-1 to 26*d*-3 (L5<L6).

The mount plate 21 provided for the socket body 20*a* in which the IC package 1 is accommodated is formed with a small diameter through hole 21*a* through which the terminal side contact shank portion 14*a* is inserted and a terminal accommodation hole 21*b* in which the solder ball 1*a* is accommodated, and a tapered portion 21*e* is formed between the small diameter through hole 21*a* and the terminal accommodation hole 21*b*.

On the other hand, the upper plate 22 is formed with a small diameter portion 22*a* through which the terminal side contact shank portion 14*a* is inserted and a large diameter through hole 22*b* into which the first flanged portion 14*b* is inserted, and a tapered portion 22*c* is formed between the small diameter through hole 22*a* and the large diameter through hole 22*b*.

Furthermore, the lower plate 23 is formed with a small diameter through hole 23*a* through which the terminal side contact member 14 is inserted and a large diameter through hole 23*b* through which the second flanged portion 15*b* is inserted, and a tapered portion 23*c* is formed between the small diameter through hole 23*a* and the large diameter through hole 23*b*.

Further, a third gap "r" having a predetermined size is formed between the small diameter through hole 21*a* and the terminal side contact shank portion 14*a*, a fourth gap "s" having a predetermined size is formed between the small diameter through hole 22*a* and the terminal side contact shank portion 14*a*, and a fifth gap "t" having a predetermined size is formed between the large diameter through hole 22*b* and the first flanged portion 14*b*. The formation of these gaps "r", "s" and "t" allows the terminal side contact member 14 to be freely tilted or inclined in the terminal accommodation hole 21*b*, the small diameter through hole 21*a*, the small diameter through hole 22*a*, the large diameter through hole 22*b* and the tapered portion 22*c*.

Furthermore, a sixth gap "u" having a predetermined size is formed between the small diameter through hole 23*a* and the substrate side contact shank portion 15*a*, and a seventh gap "v" having a predetermined size is formed between the large diameter through hole 23*b* and the second flanged portion 15*b*. The formation of these gaps "u" and "v" allows the substrate side contact member 15 to be freely tilted in the small diameter through hole 23*a*, the large diameter through hole 23*b* and the tapered portion 23*c*, or to be movable in the transverse direction as shown in FIGS. 7B and 8A.

Hereunder, the function in the case that such electric contact 24 is used will be described.

First, FIG. 5A shows the state in which the coil spring 26 expands maximally, the first flanged portion 14*b* abuts against the tapered portion 22*c* of the upper plate 22, and the second flanged portion 15*b* abuts against the tapered portion 23*c* of the lower plate 23.

As shown in FIG. 5B, the socket body 20*a* of the IC socket is mounted on the printed circuit board 2. Then, the substrate side contact shank portion 15*a* is pressed by the printed circuit board 2, and the small pitch winding portion 26*a* of the coil spring 26 is contracted in a closely wound-up state by the raising of the second flanged portion 15*b*.

In this state, when the IC package 1 is mounted, as shown in FIG. 6, on the mount plate 21 of the socket body 20*a*, the mount plate 21 is moved downward so as to approach the upper plate 22. At this time, since the small pitch winding portion 26*a* already becomes closely wound-up state, the electrically shortening (short-circuiting) is established by the small pitch winding portion 26*a*.

Thereafter, during the process of pressing and lowering the terminal side contact shank portion 14*a*, the large pitch winding portions 26*d*-1, 26*d*-2 and 26*d*-3 of the large pitch winding including portion 26*m* are contracted.

However, as shown in FIG. 7A, from the state in which the coil spring 26 expands maximally, the first flanged portion 14*b* abuts against the tapered portion 22*c* of the upper plate 22, and the second flanged portion 15*b* abuts against the tapered portion 23*c* of the lower plate 23, there may cause a case, as shown in FIG. 7B, in which the socket body 20*a* of the IC socket is mounted on the printed circuit board 2, the substrate side contact member 15 is displaced in one side in the through holes 22*b*, 23*a* and 23*b*, and the axis of the terminal side contact member 14 and the axis of the substrate side contact member 15 are shifted from each other. In such case, while the small pitch winding portion 26*a* is being contracted into the close wound state, the small pitch winding portion 26*a* inclines on the large pitch winging portion 26*c* so as to follow the shifted state.

As shown in FIG. 7B, when the substrate side contact member 15 is displaced in one side in the through holes 22*b*, 23*a* and 23*b*, the small pitch winding portion 26*a* is contracted. At the same time, in the small pitch winding portion 26*a*, as shown in FIGS. 8A and 9A, an upper side portion 26*a*-1 which is a portion above a portion corresponding to a boundary portion 15*e*-3 between the tapered portion 15*c*-1 and an even diameter portion 15*c*-2 of the small pitch winding portion 26*a* into which a tapered portion 15*c*-1 of the inserting shank portion 15*c* is inserted is tilted, and a lower side portion 26*a*-2 of the small pitch winding portion 26*a* into which the even diameter portion 15*c*-2 is inserted, takes an attitude along the vertical line.

Figure 9A:
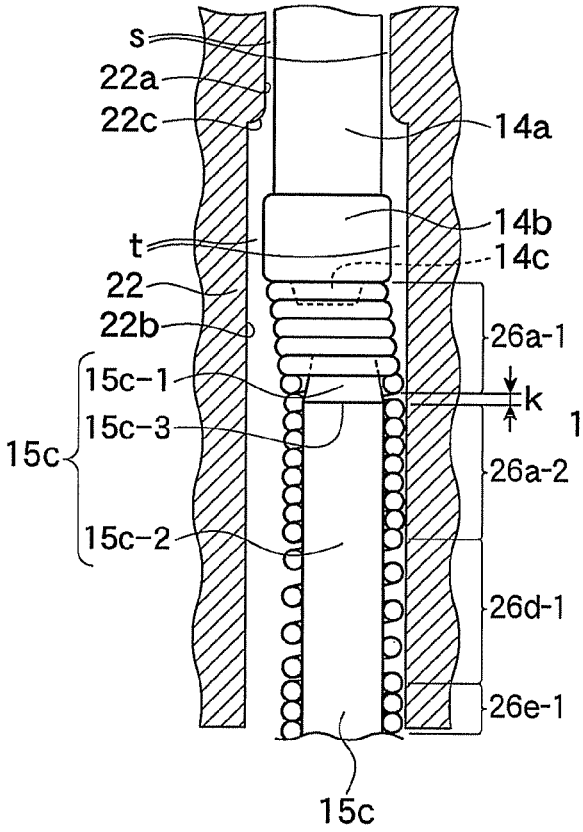
FIG. 9A is an enlarged sectional view of FIG. 8A

Next, as shown in FIGS. 8A and 9A, when the IC package 1 is mounted on the mount plate 21 of the socket body 20*a*, and the IC package 1 contacts the terminal side contact member 14, the small pitch winding portion 26*a* is compressed to thereby show the closely wound-up state with the minimum pitch. Accordingly, in this state, the electrically shortening is performed by the small pitch winding portion 26*a*.

Figure 10A:
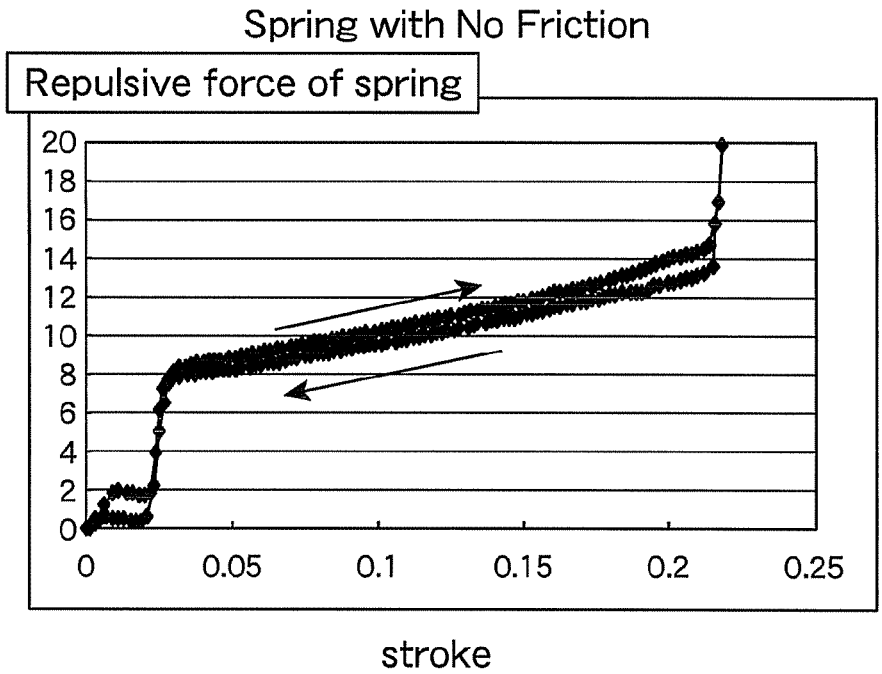
FIG. 10A is a graph representing a relationship between a spring pressure and a stroke of a coil spring according to the second embodiment.

At this instance, there causes a gap "k" between the upper side portion 26*a*-1 and the lower side portion 26*a*-2 of the small pitch winding portion 26*a*. Accordingly, the axis of the upper side portion 26*a*-1 inclines with respect to the axis of the lower side portion 26*a*-2, and the coil spring 26 follows the shifting between the axis of the terminal side contact member 14 and the axis of the substrate side contact member 15. Further, even if the substrate side inserting shank portion 15*c* enters the small pitch winding portion 26*a*, the small pitch winding portion 26*a* can be deformed, so that less friction causes between the small pitch winding portion 26*a* and the substrate side inserting shank portion 15*c*. When the electric contact 24 is formed with the coil spring 26 having such small pitch winding portion 26*a*, the relationship between the spring pressure and the stroke provides a constant proportional relationship state as shown in FIG. 10A, and accordingly, the electric contact 24 and the solder ball 1*a* are gradually contacted with a predetermined contacting pressure, thus realizing a stable short-circuiting with low friction.

Thereafter, during the process in which the terminal side contact shank portion 14*a* is pressed and lowered, the large pitch winding portions 26*d*-1, 26*d*-2 and 26*s*-3 of the large pitch winding portion including portion 26*m* are contracted.

Figure 8B:
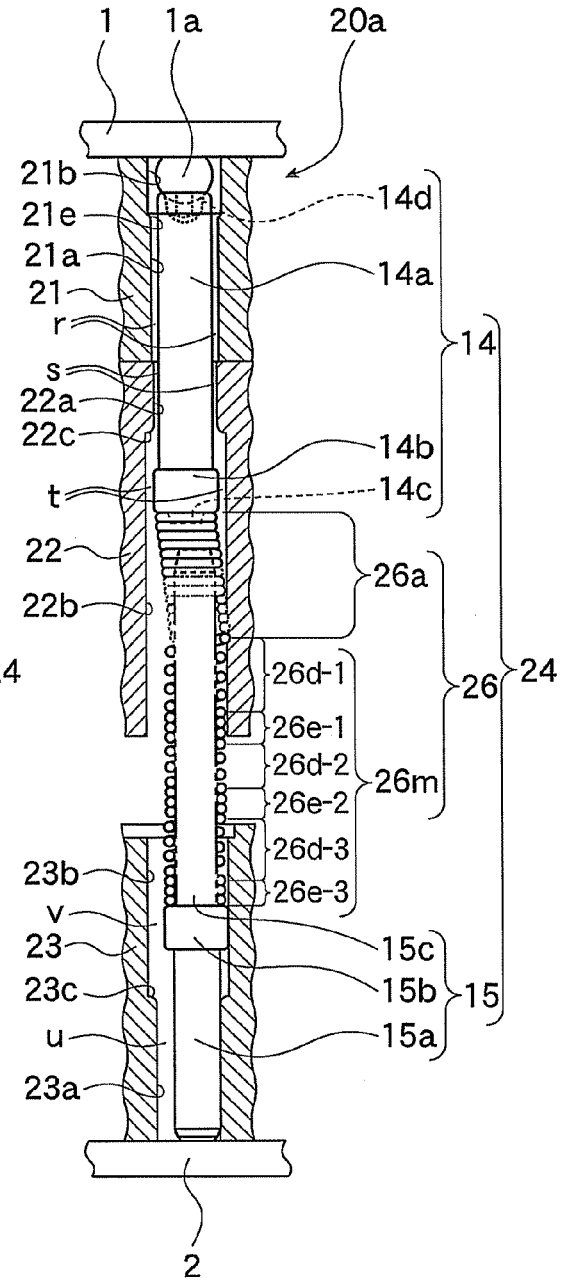
Figure 9B:
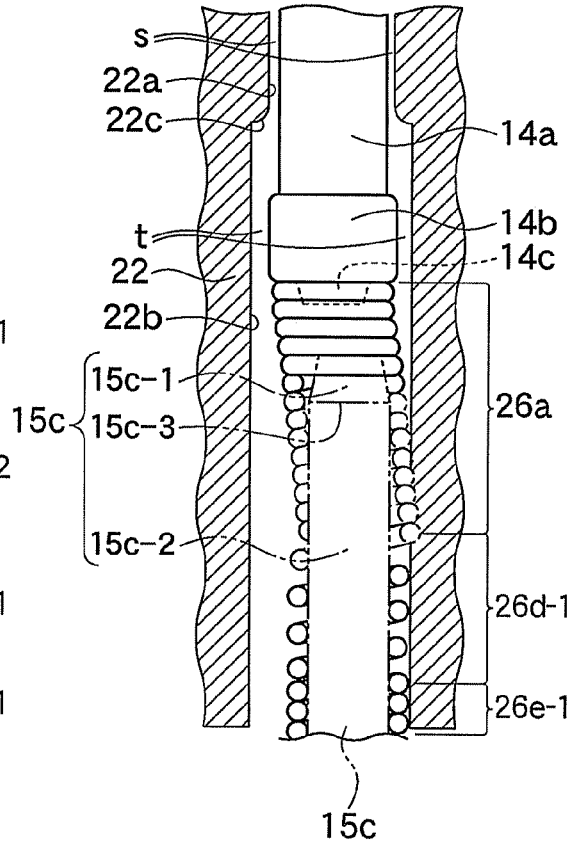
FIG. 9B is an enlarged sectional view of FIG. 8B.

Further, FIGS. 8B and 9B are views showing what function is caused by the small pitch winding portion 26*a* in a case in which the socket body 20*a* of the IC socket is mounted on the printed circuit board 2 and the IC package 1 is mounted on the mount plate 21 of the socket body 20*a* in the state that the small pitch winding portion 26*a* is initially closely wound up. In this case, the small pitch winding portion 26*a* is inclined along the inclination of the tapered portion 15*c*-1 of the inserting shank portion 15*c*, but the small pitch winding portion 26*a* is not separated into the upper side portion 26*a*-1 and the lower side portion 26*a*-2, the gap "k" is not caused between the upper side portion 26*a*-1 and the lower side portion 26*a*-2, the upper side portion 26*a*-1 is not inclined with respect to the lower side portion 26*a*-2, and the coil spring 26 does not follow the shifting between the axis of the terminal side contact member 14 and the axis of the substrate side contact member 15.

Furthermore, even if the substrate side inserting shank portion 15*c* enters into the small pitch winding portion 26*a*, the small pitch winding portion 26*a* is not deformed, so that friction is caused between the small pitch winding portion 26*a* and the substrate side inserting shank portion 15*c*.

Figure 10B:
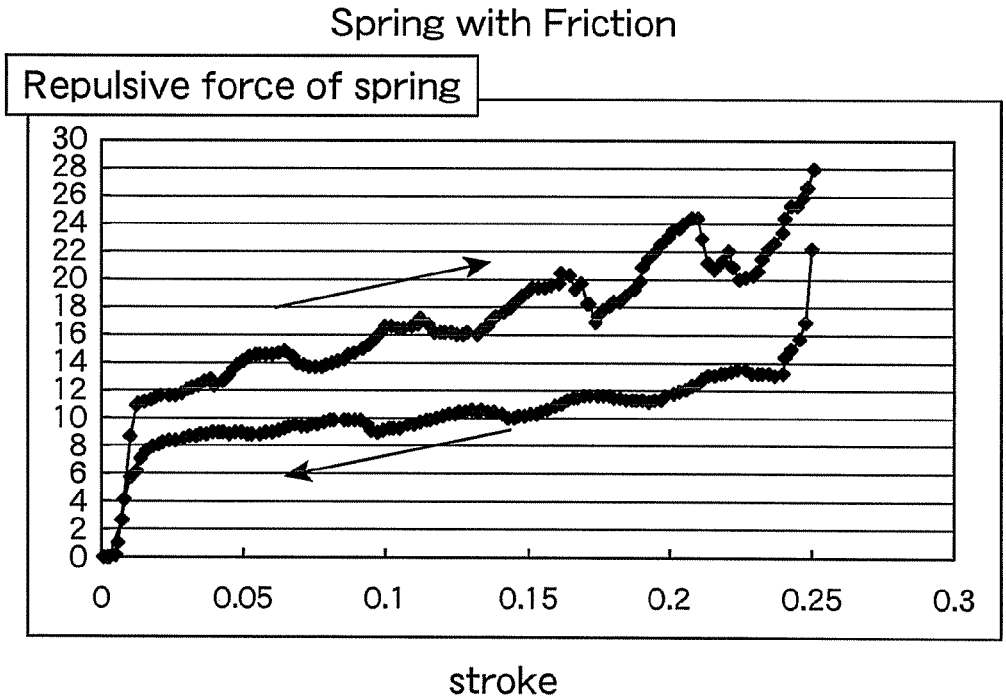
FIG. 10B is a graph representing a relationship between the spring pressure and the stroke of the coil spring in a case where the small pitch winding portion is in a closely wound-up state from an initial time.

When the electric contact 24 is composed of the coil spring 26 having such small pitch winding portion 26*a* which is initially closely wound up, the relationship between the spring pressure and the stroke does not show the constant proportional relationship such as shown in FIG. 10B. Accordingly, there are fears that the electric contact 24 and the solder ball 1*a* are not gradually contacted to each other at a predetermined contacting pressure and that a stable short-circuiting at a low friction cannot be realized.

According to such electric contact 24 of FIGS. 8A and 9A, the "first spring portion" is the small pitch winding portion 26*a* having a small pitch and the "second spring portion" is the large pitch winding portion including portion 26*m* including the large pitch winding portions 26*d*-1 to 26*d*-3 having a pitch larger than that of the small pitch winding portion 26*a*. When the IC package 1 contacts the terminal side contact member 14, the small pitch winding portion 26*a* is compressed into the minimum pitch winding state.

Because of this reason, during the process in FIGS. 8A and 9A in which the gap between adjacent turns of the winding of the small pitch winding portion 26*a* changes from the wide state to the close state, even if either one of the terminal side contact member 14 or the substrate side contact member 15 is moved transversely or inclined and the axis of the terminal side contact member 14 is shifted from the axis of the substrate side contact member 15, the coil spring 26 follows as a whole the shifting.

Furthermore, in the electric contact 24, since the adjacent turns of the winding of the small pitch winding portion 26*a* has a predetermined gap therebetween, even if a plating process is effected in the manufacturing process, the closely wound-up state at the minimum pitch is not caused from the initial stage, so that the small pitch winding portion 26*b* can be bent, thus being advantageous.

Moreover, after the causing of the closely wound-up state of the small pitch winding portion 26*a*, the small pitch winding portion 26*a* is bent by some extent by the gradual insertion of the inserting shank portion 15*c* into the spring coil, thus being also advantageous.

Third Embodiment

A third embodiment of the present invention will be described hereunder with reference to FIGS. 11A to 13, in which same reference numerals are added to portions or elements corresponding to those of the second embodiment.

The third embodiment of the present invention differs from the second embodiment in that the substrate side contact member 15 disposed in the second embodiment is not disposed in the third embodiment. In addition, in the second embodiment, the terminal side contact member 14 is provided with the inserting projection 14*c* which is inserted into the coil spring, but in this third embodiment, a terminal side contact member 35 is provided with an inserting shank portion 35*c* which is inserted into the coil spring, in place of the inserting projection 14*c*.

In addition, in the second embodiment, the coil spring 26 includes the small pitch winding portion 26*a* as "first spring portion" on the IC package side, and the large pitch winding portion including portion 26*m* as "second spring portion" on the printed circuit board side. However, in this third embodiment, the coil spring 36 includes a large pitch winding portion 36*a* as "first spring portion" on the IC package 1 side, and a small pitch winding portion 36*b* as "second spring portion" on the printed circuit board 2 side.

In this third embodiment, a socket body 30*a* of an IC socket as the "socket for an electrical part" is provided with a plate 31 through which an electric contact 33 is inserted.

The socket body 30*a* is disposed on the printed circuit board 6 (FIGS. 12A, 12B and 13), and an IC package 5 (FIG. 13) as "first electrical part" is accommodated in the socket body 30*a*. A plurality of electric contacts 33 are disposed to the socket body 30*a*, and the printed circuit board 6 as "second electrical part" and the IC package 5 are electrically connected through these electric contacts 33. Thus, the electric contacts 33 are arranged between the IC package 5 and the printed circuit board 6. Further, in FIGS. 11B and 13, only the single electric contact 33 is described, but a plurality of electric contacts 33 are actually arranged to the socket body 30*a*.

Each of the electric contacts 33 includes a terminal side contact member 35 as "first electrical part side contact member" and a coil spring 36 (FIG. 11A) contacting the printed circuit board 6 and urging the terminal side contact member 35 and the printed circuit board 6 in a direction separating from each other.

Figure 11A:
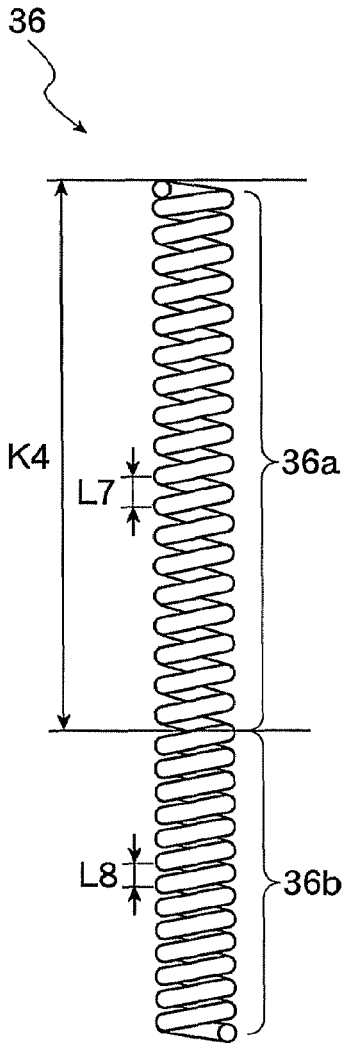
FIGS. 11A, 11B represent a relationship between an electric contact, an IC package and a printed circuit board according to a third embodiment of the present invention.
Figure 11B:
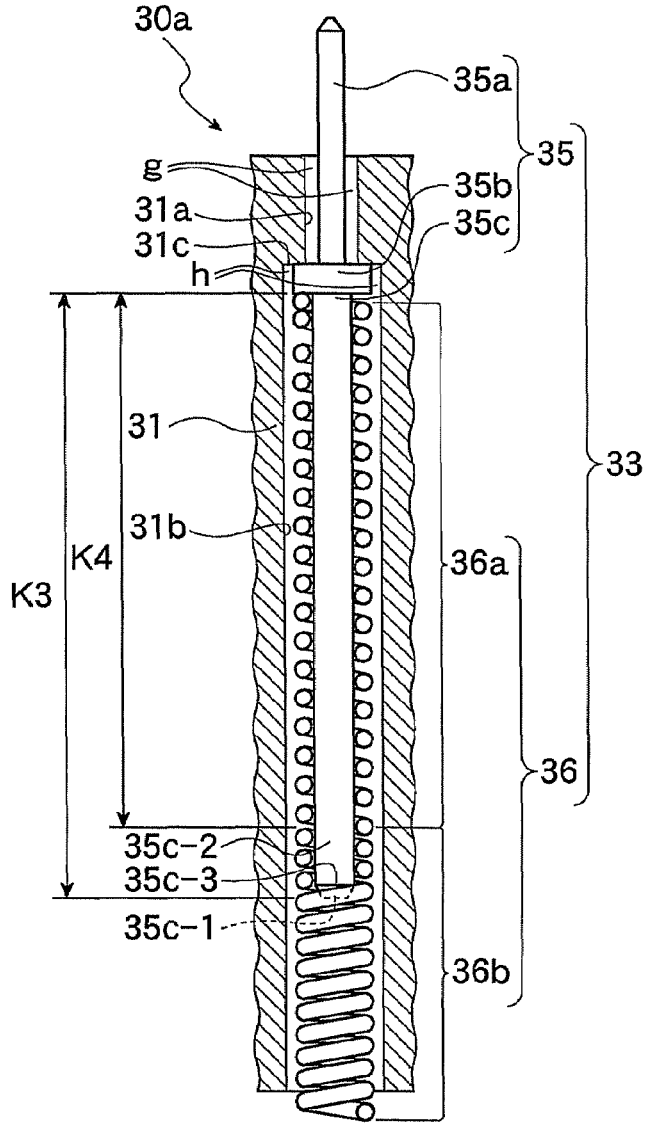

The terminal side contact member 35 includes, as shown in FIG. 11B, a terminal side contact shank portion 35*a* contacting the terminal 5*a* of the IC package 5, a third flanged portion 35*b* formed to the lower portion of the terminal side contact shank portion 35*a* by increasing a diameter thereof, and an inserting shank portion 35*c* to be inserted into the coil spring 36, from the upper side thereof, formed so as to project downward from the lower portion of the third flanged portion 35*b*.

As shown in FIG. 11B, the inserting shank portion 35*b* has a height K3 larger than a length K4 of a large pitch winding portion 36*a* of the coil spring 36 mentioned hereunder.

The coil spring 36 includes the large pitch winding portion 36*a* having a large pitch and contacting the terminal side contact member 35 and the small pitch winding portion 36*b* continuous to the large pitch winding portion 36*a* and having a pitch smaller than that of the large pitch winding portion 36*a*. However, the small pitch winding portion 36*b* has adjacent turns with gaps respectively at vertical portions of the coil spring, so that the pitch thereof is not the minimum pitch.

As shown in FIG. 11A, in the state in which the electric contact 33 does not contact the IC package 5 or the printed circuit board 6, the pitch L7 of the large pitch winding portion 36*a* is larger than the pitch L8 of the small pitch winding portion 36*b* (L7>L8).

The socket body 30*a* accommodating the IC package 5 has a plate 31 as mentioned before. The plate 31 is formed with a small diameter through hole 31*a* through which the terminal side contact shank portion 35*a* is inserted and a large diameter through hole 31*b* through which the third flanged portion 35*b* is inserted, and a stepped portion 31*c* is formed between the small diameter through hole 31*a* and the large diameter through hole 31*b*.

The function of such electric contact 33 will be described hereunder.

First, as shown in FIG. 11B, the coil spring 36 expands maximally, and the third flanged portion 35*b* abuts against the stepped portion 31*c* of the plate 31.

Figure 12A:
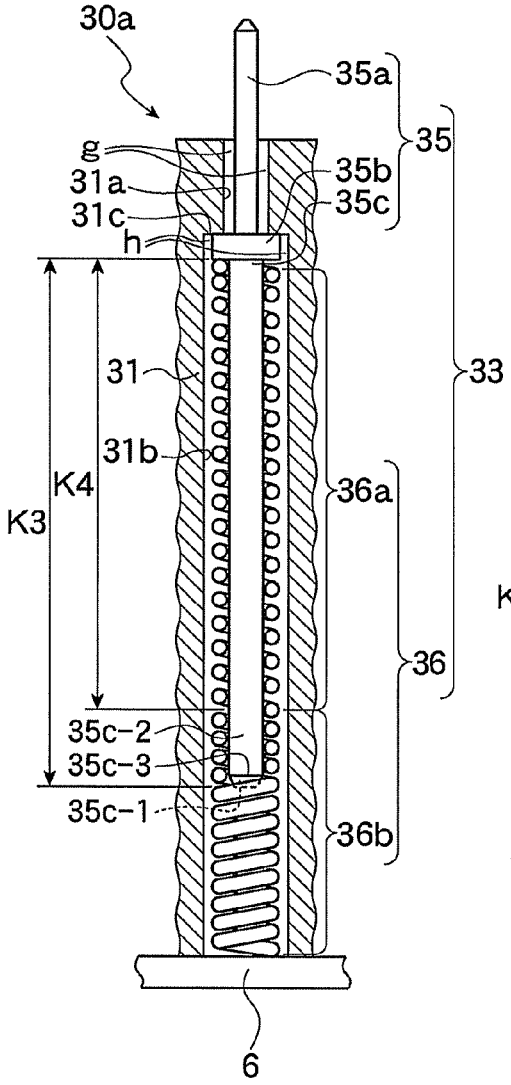
FIGS. 12A, 12B represent a relationship between the electric contact, the IC package and the printed circuit board according to the third embodiment of the present invention.

Next, as shown in FIG. 12A, the socket body 30*a* of the IC socket is mounted on the printed circuit board 6. Then, the coil spring 36 is pressed to the printed circuit board 6 to thereby contract the small pitch winding portion 36*b* of the coil spring 36.

Figure 12B:
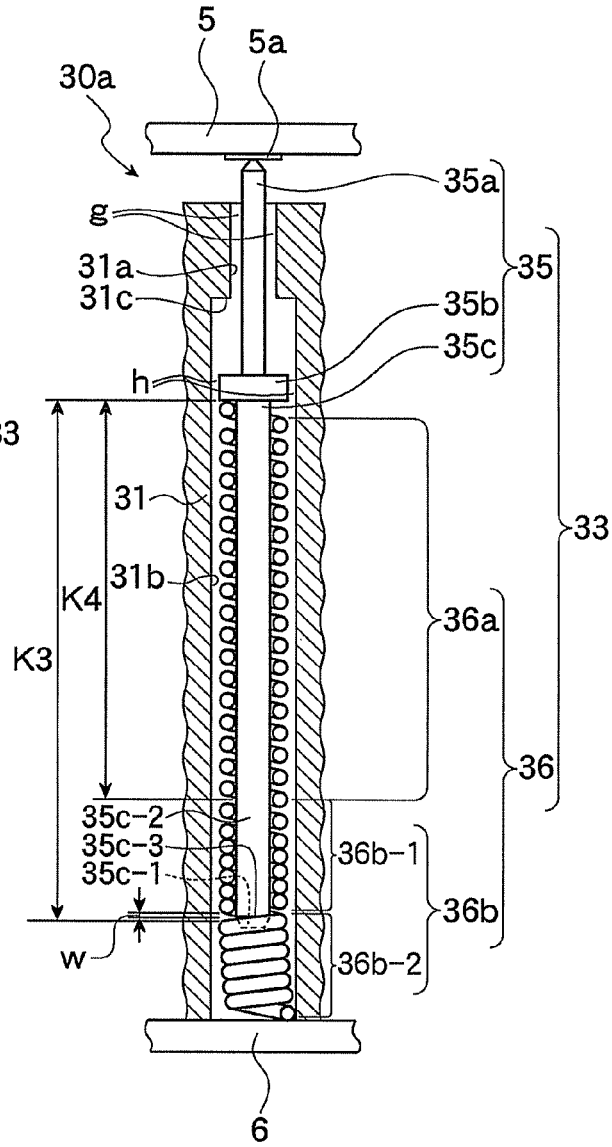

Under this state, as shown in FIG. 12B, the IC package 5 is mounted on the plate 31 of the socket body 30*a*, the terminal side contact shank portion 35*a* is pressed by the terminal 5*a* of the IC package 5. Then, the terminal side contact member 35 is lowered, and the third flanged portion 35*b* is separated from the stepped portion 31*c* of the plate 31. At this time, the small pitch winding portion 36*b* becomes gradually the closely wound-up state from the state of the pitch L8. The lower side portion 36*b*-2 which is a portion below a portion corresponding to a boundary portion 35*c*-3 between the tapered portion 35*c*-1 and the even diameter portion 35*c*-2 of the small pitch winding portion 36*b* into which the tapered portion 35*c*-1 of the inserting shank portion 35*c* inserted, is inclined. At this time, a gap "w" is formed between the upper side portion 36*b*-1 and the lower side portion 36*b*-2. As mentioned, by inclining the axis of the lower side portion 36*b*-2 with respect to the axis of the upper side portion 36*b*-1, even if a transverse shifting of the axis of the terminal side contact member 35 is caused with respect to the axes of the small diameter through hole 31*a* and the large diameter through hole 31*b*, the coil spring 36 does follow. The electric contact 33 and the terminal 5*a* is gradually contacted at the predetermined contacting pressure, and the IC package 5 and the printed circuit board 6 are electrically short-circuited by the small pitch winding portion 36*b*.

Figure 13:
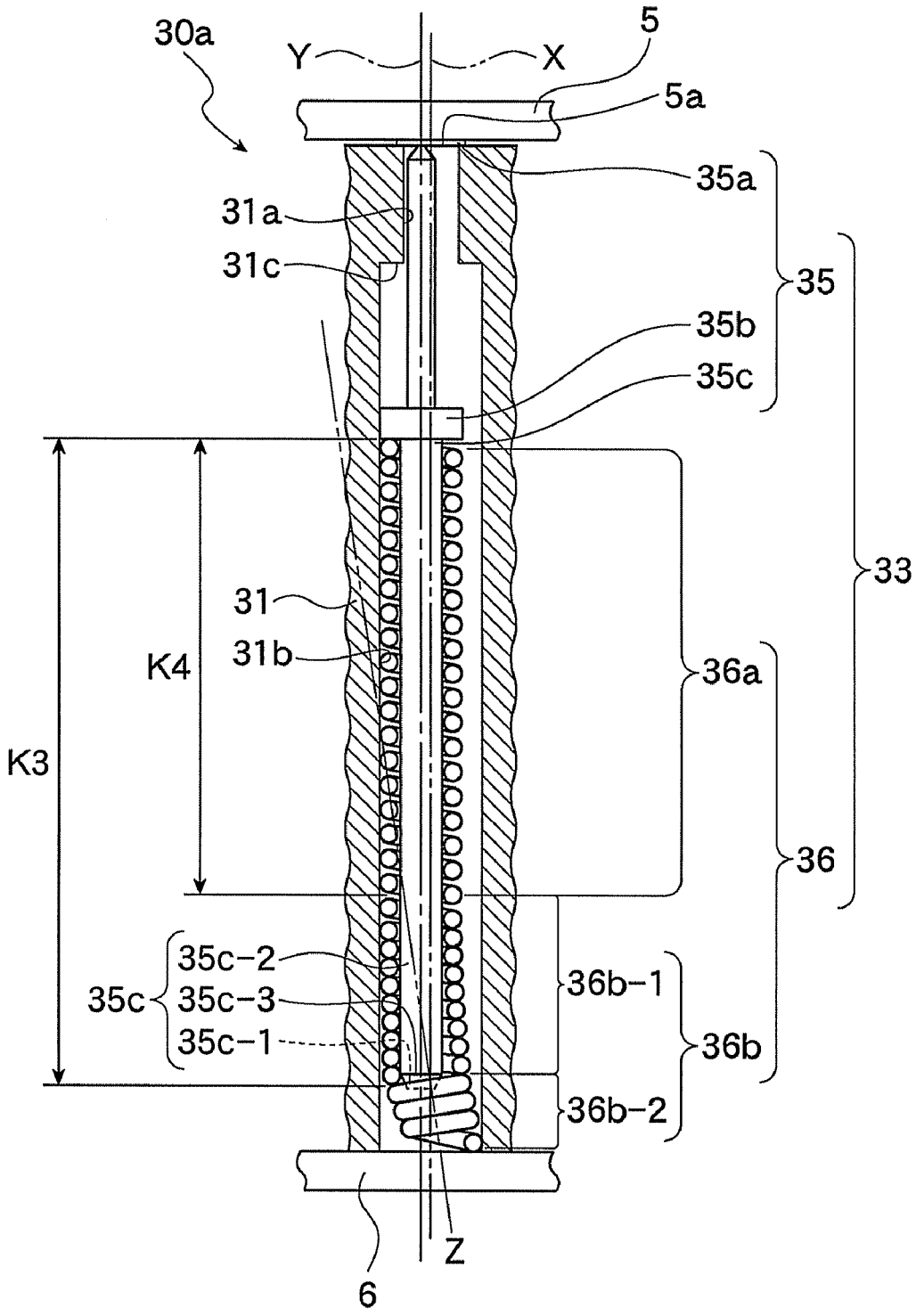
FIG. 13 represents a relationship between the electric contact, the IC package and the printed circuit board according to the third embodiment of the present invention, in which the IC package is disposed on the socket body, and the terminal side contact member is maximally lowered.

Then, as shown in FIG. 13, when the IC package 5 is further lowered toward the third plate 31, the IC package 5 pushes the terminal side contact member 35, the terminal side contact member 35 is moved toward the inner wall side of the large diameter through hole 31*b*, and the small pitch winding portion 36*b* moves so as to provide the closely wound-up state. At this time, then, the inclined surface of the tapered portion 35*c*-1 of the inserting shank portion 35*c* of the terminal side contact member 35 is lowered along the inner wall of the closely wound-up small pitch winding portion 36*b*. Thereafter, during the process in which the terminal side contact shank portion 35*a* is pressed and lowered, the large pitch winding portion is being contracted.

The thus described electric contact 33 is provided with the terminal side contact member 35 contacting the IC package 5 and the coil spring 36 contacting the printed circuit board 6 and urging the printed circuit board 6 in a direction separating from the terminal side contact member 35. The coil spring 36 is provided with the large pitch winding portion 36*a* abutting against the terminal side contact member 35 and the small pitch winding portion 36*b* being continuous to the large pitch winding portion 36*a* and having the pitch smaller than that of the large pitch winding portion 36*a*.

When the IC package 5 is contacted to the terminal side contact member 35, the small pitch winding portion is compressed into the minimally wound-up state, and then, the terminal side contact member 35 becomes movable in the transverse direction by the inclination of the axis of the small pitch winding portion 36*b* with respect to the axis of the large pitch winding portion 36*a*.

Therefore, during the process in which the small pitch winding portion 36*b* is transferred from the state in which a gap is present between the vertically adjacent two turns of the small pitch winding portion 36*b* of the coil spring 36 to the closely wound-up state, even if either one of the terminal side contact member 35 or the small pitch winding portion 36*b* is moved transversely or inclined, and then, the axis of the terminal side contact member 35 is shifted from axes of the small and large diameter through holes 31*a* and 31*b*, the coil spring can follow entirely such shifting.

Further, according to this third embodiment, although the large pitch winding portion 36*a* has the pitch entirely larger than that of the small pitch winding portion 36*b*, the present invention is not limited to this embodiment. That is, a close winding portion having the minimum pitch is provided to a predetermined portion of the large pitch winding portion 36*a* to thereby prevent such coil spring 35 of one electric contact 33 from entangling with adjacent other coil springs 36 at the manufacturing process.

Figure 14:
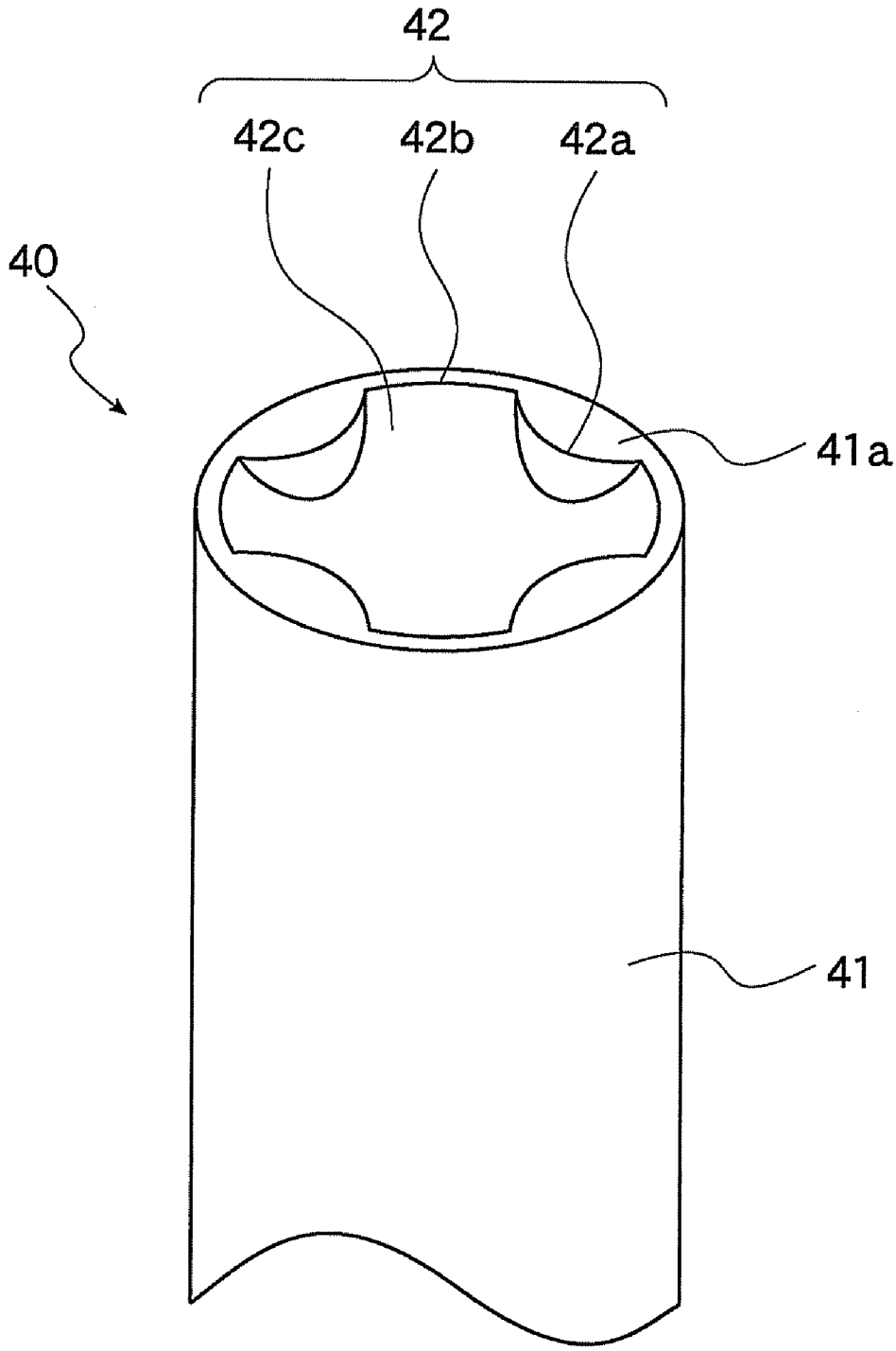
FIG. 14 is a perspective view showing another example of a terminal side contact member of an electric contact disposed on the IC socket according to the third embodiment.

Furthermore, according to the first and second embodiments of the present invention, although the contact recess 14*d* of the terminal side contact member 14 includes, as shown in FIG. 4C to 4E, from the opening side, the large circular recessed portion 14*d*-1 and the small circular recessed portion 14*d*-2, the present invention is not limited to these embodiments, and the following alternation may be adopted. For example, as shown in FIG. 14, a flat contact end surface 41*a* is formed to the outer edge side of the upper portion of the terminal side contact shank portion 41 of the terminal side contact member 40, and a recess 42 is formed to the central side of the upper portion of the terminal side contact shank portion 41. This recess 42 has an approximately "+ (cross)"-shape in a plan view, and is surrounded by a projected portion 42*a* projecting toward the center from the contact end surface 41*a* and a circular-arc edge portion 42*b* not projecting toward the center from the contact end surface 41*a*.

Still furthermore, the recess 42 is formed with an oblique surface 42*c* which is downward inclined toward the center from the edge portion 42*b*. In addition, the recess 42 is formed, as shown in FIG. 14, to be a conical shape in a manner such that the inner surface of the recess inclines from the edge portion 42*b* toward the center of the terminal side contact shank portion 41. Further, the oblique surface 42*c* may be formed unidirectionally from the edge portion 42*b*. In addition, the bottom surface of the recess 42 is formed to provide a spherical shape in conformity with the ball-shaped solder ball 1*a* so as to accommodate the solder ball 1*a*.

The projected portion 42*a* acts to break an oxide film formed on the surface of the solder ball 1*a* so as to ensure the stability of the electrically contacting state to the connection terminal, and as shown in FIG. 14, four projected portions 42*a*, each having substantially semi-circular transverse section, are provided in the circumferential direction with an interval of 90 degrees. Further, the shape of the projected portion 42*a* is not limited to this semicircular shape in the transverse section, and triangular shape may be for example adopted. Furthermore, the projected portions 42*a* may be disposed to at least one portion without being limited to four.

It is to be noted that, as mentioned above, the present invention is not limited to the described embodiments and many other changes and modifications may be made without departing from the scopes of the appended claims.

What is claimed is:

1. An electric contact disposed between a first electrical part and a second electrical part so as to electrically connect the first and second electrical parts, comprising:

a first electrical part side contact member contacting the first electrical part;

a second electrical part side contact member contacting the second electrical part, a coil spring urging the first electrical part side contact member and the second electrical part side contact member in a direction separating from each other, the coil spring including a first spring portion abutting against the first electrical part side contact member and a second spring portion abutting against the second electrical part side contact member, wherein when the first electrical part contacts the first electrical part side contact member, an axis of the first spring portion inclines with respect to an axis of the second spring portion, and then, a portion of the first electrical part side contact member on a side contacting the first electrical part is transversely moved, and the first spring portion of the coil spring is a first close winding portion closely wound-up at a minimum pitch, the second spring portion is a normal winding portion including portion having a normal winding portion wound-up at a predetermined pitch, a rough winding portion is continuously formed between the first close winding portion and the normal winding portion so as to have a pitch larger than that of the first close winding portion and smaller than that of the normal winding portion, and when the first electrical part contacts the first electrical side contact member, the rough winding portion is contracted so that a lower portion of the first close winding portion and an upper portion of the normal winding portion including portion are contacted to each other.

2. The electric contact according to claim 1, wherein an upper portion of the normal winding portion including portion is a second close winding portion continuously connected to an upper portion of the normal winding portion at a minimum pitch.

3. An electric contact disposed between a first electrical part and a second electrical part so as to electrically connect the first and second electrical parts, comprising:

a first electrical part side contact member contacting the first electrical part;

a second electrical part side contact member contacting the second electrical part, a coil spring urging the first electrical part side contact member and the second electrical part side contact member in a direction separating from each other, the coil spring including a first spring portion abutting against the first electrical part side contact member and a second spring portion abutting against the second electrical part side contact member, wherein when the first electrical part contacts the first electrical part side contact member, an axis of the first spring portion inclines with respect to an axis of the second spring portion, and then, a portion of the first electrical part side contact member on a side contacting the first electrical part is transversely moved, and the first electrical part side contact member includes: a first electrical part side contact shank portion contacting the first electrical part; a first flanged portion provided for the lower portion of the first electrical part side contact shank portion so as to provide a wider diameter shape; and an inserting projection formed from the lower portion of the first flanged portion so as to project downward to be inserted into the first spring portion from an upper side thereof, the second electrical part side contact member includes: a second electrical part side contact shank portion contacting the second electrical part; a second flanged portion provided for the upper portion of the second electrical part side contact shank portion so as to provide a wider diameter shape; and an inserting shank portion formed from the upper portion of the second flanged portion so as to project upward to be inserted into the second spring portion from a lower side thereof, and the rough winding portion is disposed between the inserting projection and the inserting shank portion.

4. The electric contact according to claim 3, wherein the inserting projection has a height smaller than a length of the first close winding portion.

5. The electric contact according to claim 3, wherein a lower portion of the normal winding portion including portion is a third close winding portion continuously connected to the lower portion of the normal winding portion at a minimum pitch, and a lower end of the third close winding portion abuts against the second flanged portion of the second electrical part side contact member.

6. The electric contact according to claim 1, wherein the first spring portion is a small pitch winding portion and the second spring portion is a large pitch winding portion including portion having a pitch larger than that of the first spring portion, and when the first electrical part contacts the first electrical part side contact member, the small pitch winding portion is compressed into a closely wound-up state having a minimum pitch.

7. A socket for an electrical part including a socket body and an electric contact disposed between a first electrical part and a second electrical part so as to electrically connect the first and second electrical parts, the electric contact including: a first electrical part side contact member contacting the first electrical part; a second electrical part side contact member contacting the second electrical part, the coil spring including a first spring portion abutting against the first electrical part side contact member and a second spring portion abutting against the second electrical part side contact member, wherein when the first electrical part contacts the first electrical part side contact member, an axis of the first spring portion inclines with respect to an axis of the second spring portion, and then, a portion of the first electrical part side contact member on a side contacting the first electrical part is transversely moved, and wherein the first electrical part is an IC package, the second electrical part is a printed circuit board, the first electrical part side contact member is a terminal side contact member contacting a terminal of the IC package, and the second electrical part side contact member is a substrate side contact member contacting the printed circuit board, wherein the socket body in which the IC package is accommodated has a plate through which the terminal side contact member is inserted, the plate is provided with a small diameter through hole through which the terminal side contact shank portion is inserted and a large diameter through hole through which the first flanged portion is inserted, a first gap having a predetermined size is formed between the small diameter through hole and the terminal side contact shank portion, a second gap having a predetermined size is formed between the large diameter through hole and the first flanged portion, and the terminal side contact member is tilted in the small diameter through hole and the large diameter through hole.

* * * * *